United States Patent [19]

Brigham, deceased et al.

[11] 3,989,001

[45] Nov. 2, 1976

[54] MACHINE FOR SPRAY-COATING CAN BODY EXTERIORS

[75] Inventors: Roger S. Brigham, deceased, late of Crete, Ill.; by Loraine M. Brigham, sole heir, Harwood Heights, Ill.

[73] Assignee: Continental Can Company, Inc., New York, N.Y.

[22] Filed: Feb. 18, 1971

[21] Appl. No.: 116,673

Related U.S. Application Data

[63] Continuation of Ser. No. 603,709, Dec. 16, 1966, abandoned.

[52] U.S. Cl. ..... 118/7; 118/50; 118/314; 118/322; 118/326; 118/503

[51] Int. Cl.[2] ..... B05C 5/00; B05C 11/10

[58] Field of Search ..... 118/2, 9, 7, 230, 319, 118/313, 314, 315, 322, 326, 50, 503; 279/3, 24; 117/105.3

[56] References Cited

UNITED STATES PATENTS

| | | | |
|---|---|---|---|
| 791,745 | 6/1905 | Bailey | 118/230 |
| 1,392,220 | 9/1921 | Quint | 279/24 UX |
| 1,744,313 | 1/1930 | Kadow | 279/3 |
| 1,894,729 | 1/1933 | Bozarth | 118/322 X |
| 2,330,880 | 10/1943 | Gladfelter et al. | 118/313 |
| 2,376,980 | 5/1945 | Peterson et al. | 118/2 |
| 2,426,391 | 8/1947 | Emerson | 118/319 X |
| 2,675,778 | 4/1954 | Peeps | 118/2 |
| 2,800,872 | 7/1957 | Remington et al. | 118/230 X |
| 3,355,310 | 11/1967 | Dejean et al. | 118/308 X |

*Primary Examiner*—John P. McIntosh
*Attorney, Agent, or Firm*—Diller, Brown, Ramik & Wight

[57] ABSTRACT

This invention relates to a coating apparatus for coating the exterior of articles passing spray nozzles which are sequentially operated to prevent coating material from passing between adjacent articles. Each spray nozzle is operated to either apply a partial coating, a complete coating or several coatings to each article. The apparatus also includes timing screw and a turret conveyor which are rapidly stopped by means responsive to article jamming, and means are provided for facilitating the removal of jammed articles from a housing of the timing screw.

21 Claims, 20 Drawing Figures

INVENTOR

ROGER S. BRIGHAM (Deceased)
Administered By
LORAINE M. BRIGHAM (Executrix)

BY

Mason, Porter, Miller & Brown
ATTORNEYS

INVENTOR
ROGER S. BRIGHAM (Deceased)
Administered By
LORAINE M. BRIGHAM (Executrix)

BY
Mason, Porter, Willey & Brown
ATTORNEY

INVENTOR
ROGER S. BRIGHAM (Deceased)
Administered By
LORAINE M. BRIGHAM (Executrix)

BY
Mason, Porter, Miller & Brown
ATTORNEY

INVENTOR
ROGER S. BRIGHAM (Deceased)
Administered By
LORAINE M. BRIGHAM (Executrix)

BY
Mason, Porter, Weller & Brown
ATTORNEY

INVENTOR
ROGER S. BRIGHAM (Deceased)
Administered By
LORAINE M. BRIGHAM (Executrix)

BY
Mason, Porter, Weller & Brown
ATTORNEYS

INVENTOR
ROGER S. BRIGHAM (Deceased)
Administered By
LORAINE M. BRIGHAM (Executrix)

BY
Mason, Porter, Willer & Brown
ATTORNEYS

INVENTOR
ROGER S. BRIGHAM (Deceased)
Administered By
LORAINE M. BRIGHAM (Executrix)

BY
Mason, Porter, Villers & Brown
ATTORNEYS

INVENTOR
ROGER S. BRIGHAM (Deceased)
Administered By
LORAINE M. BRIGHAM (Executrix)

BY
Mason, Porter, Villers & Brown
ATTORNEYS

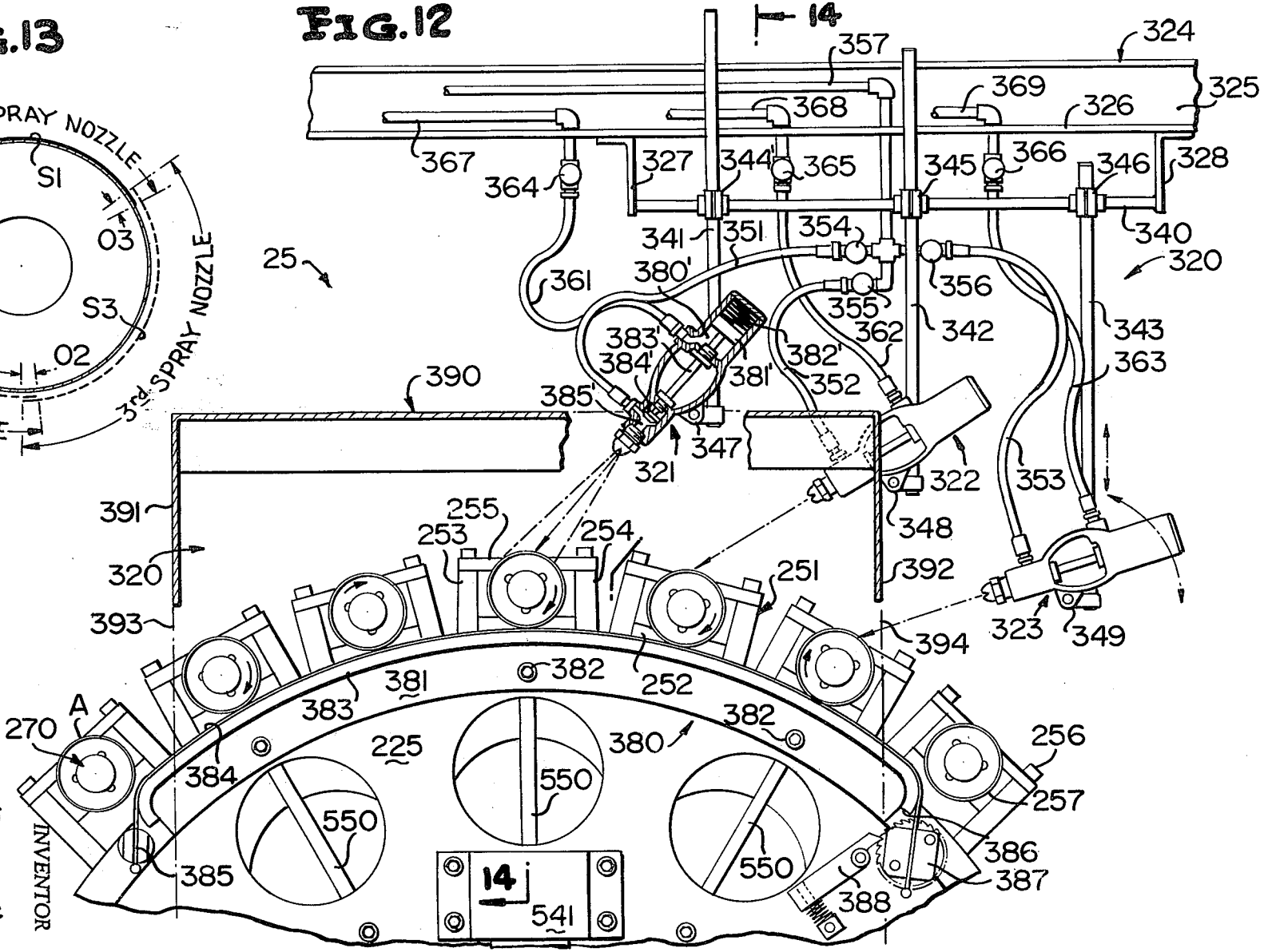
INVENTOR
ROGER S. BRIGHAM (Deceased)
Administered By
LORAINE M. BRIGHAM (Executrix)
BY
Mason, Porter, Miller & Brown
ATTORNEY INVENTOR
ROGER S. BRIGHAM (Deceased)
Administered By
LORAINE M. BRIGHAM (Executrix)

BY
Mason, Porter, Miller & Brown
ATTORNEYS

INVENTOR
ROGER S. BRIGHAM (Deceased)
Administered By
LORAINE M. BRIGHAM (Executrix)

BY
Mason, Porter, Vilas & Brown
ATTORNEYS

INVENTOR
ROGER S. BRIGHAM (Deceased)
Administered By
LORAINE M. BRIGHAM (Executrix)

BY
Mason, Porter, Willes & Brown
ATTORNEYS

INVENTOR
ROGER S. BRIGHAM (Deceaced)
Administered By
LORAINE M. BRIGHAM (Executrix)

BY
Mason, Porter, Willers & Brown
ATTORNEYS

MACHINE FOR SPRAY-COATING CAN BODY EXTERIORS

This is a continuation of application Ser. No. 603,709, filed Dec. 16, 1966, now abandoned.

Conventional machines for spray-coating the exteriors of hollow bodies, such as can or container bodies, are relatively well-known and generally include a main conveyor which transports the articles on individual rotatable mandrels to and through a coating station. The coating station may include one or more spray nozzles which continuously direct a spray of coating material against the exteriors of the articles as the latter are rotated about their individual axes. A major disadvantage of such conventional coating machines is the excessive waste of coating material resulting from the continuous operation of the spray nozzles which is augmented by the disposition of the spray nozzles generally normal to the path of travel of the articles through the spraying or coating station. During the movement of each article past a selected spray nozzle and prior to a succeeding article reaching the spray nozzle the coating material spray merely passes through the space between the adjacent articles and is either wasted or suitable means are provided for returning the accumulated coating material to the original source thereof. This latter procedure is undesirable from the standpoint of providing additional apparatus for returning the coating material to its source such as a collection reservoir, conduit, pumps, etc., and the tendency of dirt or other foreign material to admix with the coating material and cause subsequent jamming of the spray nozzle orifices. A further disadvantage of such conventional arrangements is the tendency to apply excessive coating material to each article and accordingly increases the cost of the coating procedure.

In accordance with this invention the above and similar disadvantages of conventional coating machines are overcome by disposing a plurality of spray nozzles along a path of travel defined by a conveyor carrying the articles, and providing means for actuating one of the spray nozzles to direct coating material at a surface portion of one article only as it passes thereby and thereafter actuating another of the spray nozzles to direct coating material at the article only when the article passes thereby. In this manner, the spray emitted by the nozzles is directed toward a particular article and each nozzle is selectively de-activated to prevent the spray from passing through the space between adjacent articles, thereby preventing excessive coating of the article and appreciably reducing the loss of coating material.

A further object is to provide a novel machine of the type described wherein means are provided for rotating the articles about their axes to completely or partially coat each article as it passes each nozzle, and in the latter case, effect partial overlapping of successively applied layers of the coating material.

A further object of this invention is to provide a novel coating apparatus or machine of the type heretofore described wherein the articles are supported upon individual rotatable mandrels during the movement thereof past the nozzles each of the mandrels including clamping means for holding the articles on the mandrels, the clamping means being in the form of novel mechanical or vacuum-type clamping mechanisms, and means for releasing the clamping means at the termination of the spraying operation and in sequence with a take-away conveyor for additional treatment as, for example, conveying the coated articles to a drying oven to harden and set the coating material.

In conventional coating machines of the type heretofore described it is also quite common to feed the articles to the main conveyor by a timing or feed screw and an article transfer turret. During the relatively rapid movement of the articles from the timing screw to the transfer turret and then to the main conveyor jamming between the articles and the various feeding and conveying mechanisms may occur. Such jamming generally results as a result of improper timing between the various transfer mechanisms whereupon an article may be, for example, delivered too early or too late to a pocket of the transfer turret by the timing screw or like misdelivery from the transfer turret to a mandrel of the main conveyor. If the apparatus is not immediately stopped numerous articles can be damaged thereby resulting in waste and attended high production costs. In addition, each time a jam occurs and the apparatus is stopped the articles must be removed the apparatus cleared prior to being restarted, thereby increasing the down time of the apparatus and correspondingly increasing the processing costs.

It is, therefore, a further object of this invention to provide a novel coating apparatus which includes a timing screw and a transfer turret for feeding articles which are to be coated to the main conveyor, and both the timing screw and the transfer turret being provided with means for detecting article jamming and immediately in response thereto de-activating the main conveyor of the apparatus to prevent excessive article damage.

A further object of this invention is to provide a novel apparatus of the type immediately above-described wherein the timing screw defines a portion of a housing through which articles are fed to transfer turret, drive means are provided at an end portion of the timing screw for applying rotation thereto, and further means are provided at the same end portion of the timing screw to pivot the timing screw to an out of the way position to facilitate the removal of articles from the housing should jamming occur.

Still another object of this invention is to provide a novel apparatus of the type heretofore described wherein the detecting means associated with the timing screw is a cam follower carried by an opposite end portion of the timing screw which is urged away from a normal position by jammed articles, and means responsive to the movement of the cam follower from its normal position to deactivate the main drive of the apparatus.

Yet another object of this invention is to provide a coating apparatus of the type heretofore described wherein the de-activating means for the article transfer turret is a clutch mechanism, the clutch mechanism including driven, driving and clutch discs disposed in surrounding relationship to a drive shaft, the driven disc including means for transferring the articles from the feed screw to the main conveyor, means for releasably coupling the driving and driven discs, means urging the clutch disc toward the driving and driven discs to normally maintain the releasable coupling means in coupling engagement whereby rotation of the driving disc imparts rotation to the driven disc and articles carried thereby, means for driveably connecting the drive shaft to the driving disc, means for effecting movement of the clutch disc away from the driving disc in response to jamming forces tending to retard the rotation of the driven disc whereby the coupling means is released and rotation of the driven disc is prevented, and means for adjustably regulating the urging means to apply a pre-determined force against the clutch and the releasable coupling means beyond which the coupling means is released whereby the driven disc is stopped at any selected predetermined force of retardation.

A further object of this invention is to provide a novel apparatus of the type heretofore set forth wherein the connecting means between the drive shaft and the driving disc includes a pin projecting radially outwardly of the drive shaft, a recess in the driving disc, the pin being received in the recess whereby rotation of the drive shaft is transmitted to the driving disc through the pin and recess, the drive shaft including an axial bore, a rod housed in the bore, a first end portion of the rod contacting the pin, and means connecting an opposite end portion of the rod to the main power source for de-activating the same in response to movement of the rod resulting from articles jamming within the transfer turret.

With the above and other objects in view that will hereinafter appear, the nature of the invention will be more clearly understood by reference to the following detailed description, the appended claimed subject matter, and the several views illustrated in the accompanying drawings.

IN THE DRAWINGS

FIG. 12 is a fragmentary enlarged sectional view taken generally along line 12—12 of FIG. 2, and more clearly illustrates the position of the spray nozzles relative to the main conveyor and the details of one of the spray nozzles.

FIG. 13 is a radial cross sectional view taken through a coated article, and diagrammatically illustrates the circumferential surface portions of the article coated by the spray nozzles of FIG. 12.

Figure 1:
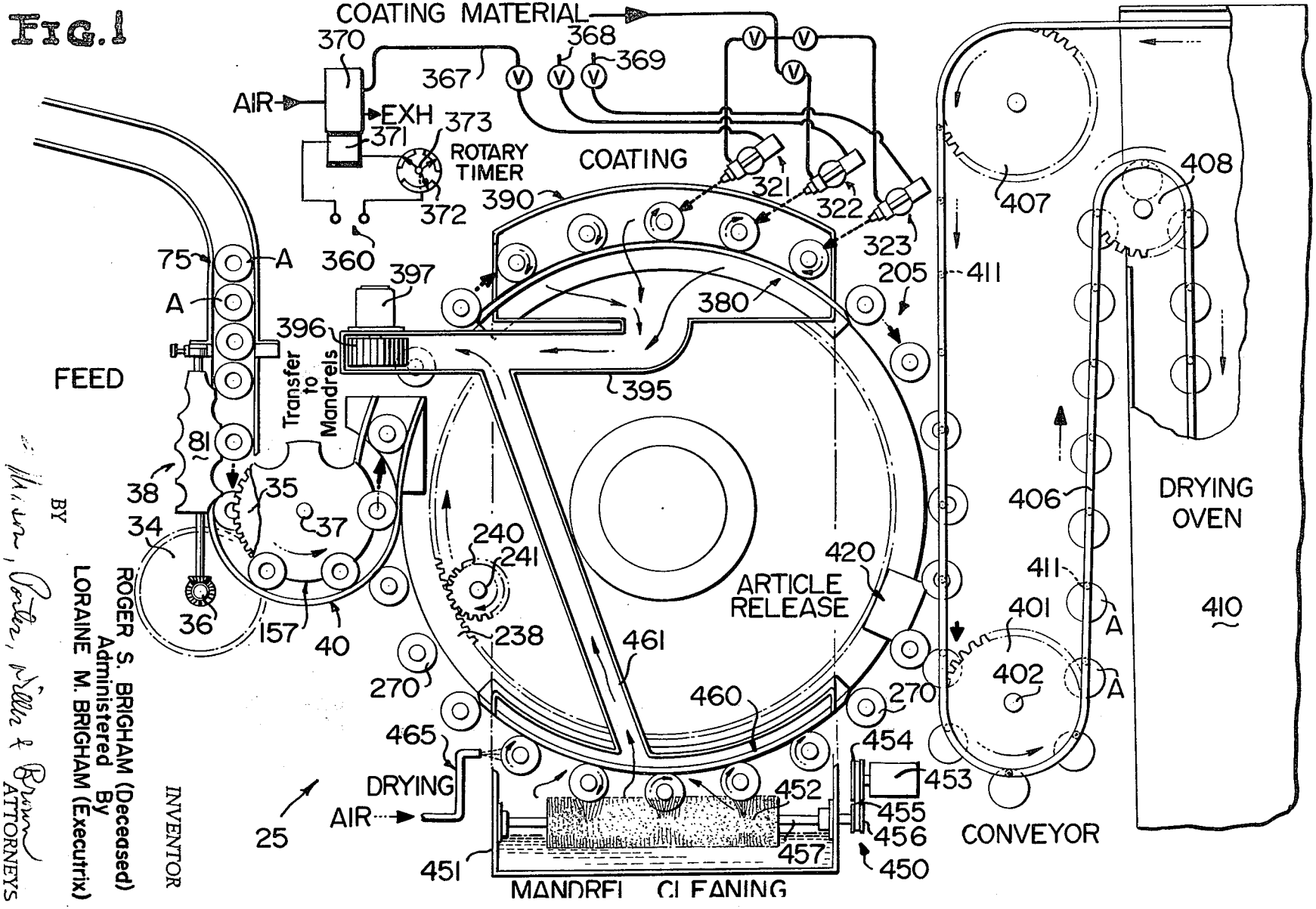
FIG. 1 is a highly schematic partial fragmentary front elevational view of a novel spray-coating apparatus of this invention, and illustrates a timing screw and a transfer turret for feeding articles to rotatable mandrels of a main conveyor, nozzles for spray-coating the exteriors of the articles, a take-away conveyor, and a mandrel cleaning station upstream of the sprayed articles.
Figure 2:
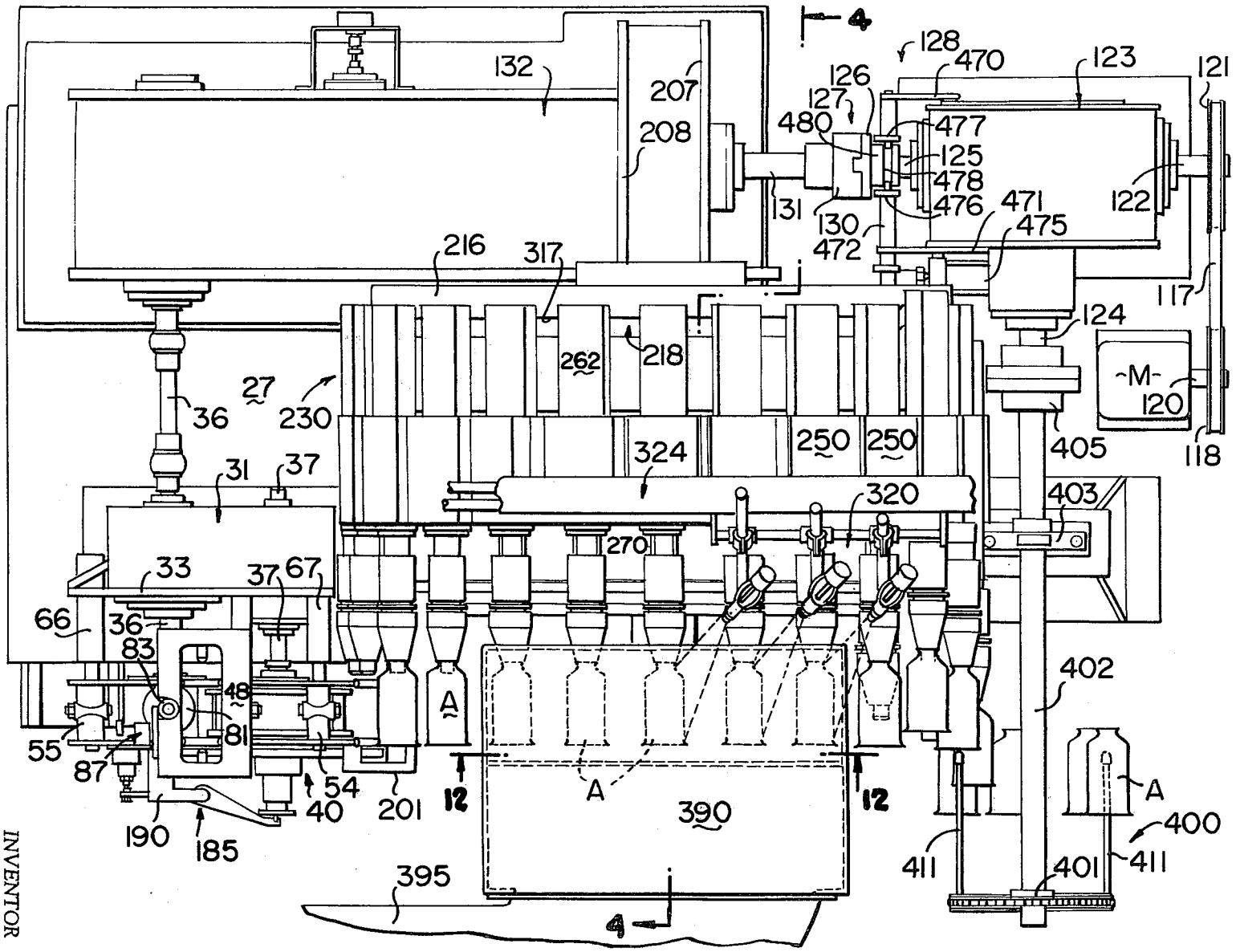
FIG. 2 is a top plan view of the coating apparatus of FIG. 1, and illustrates the particular alignment of the spray nozzles relative to the articles carried by the mandrels during a spraying operation, and the subsequent transfer of the sprayed or coated articles to the take-away conveyor.
Figure 3:
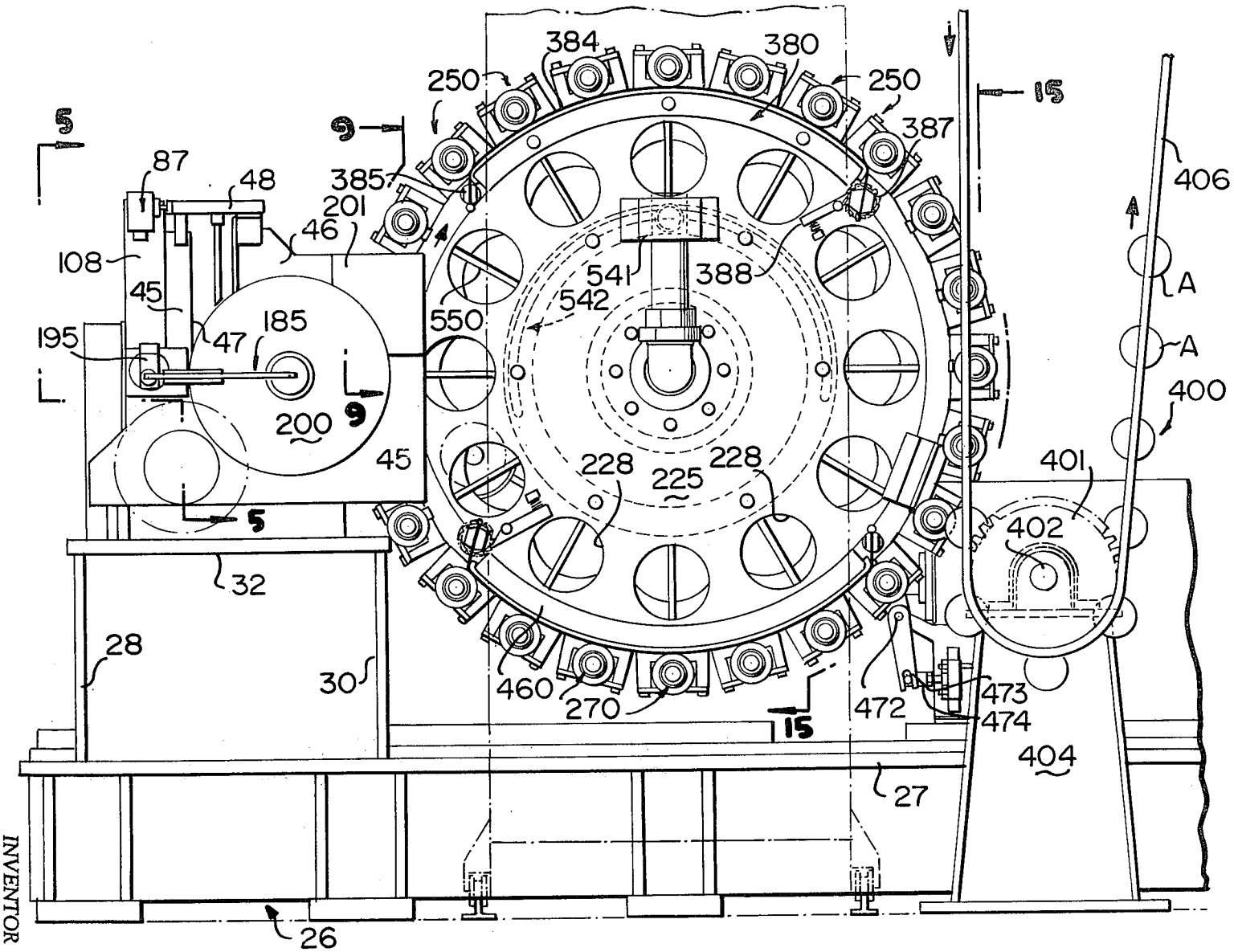
FIG. 3 is a fragmentary front elevational view of the coating apparatus of FIG. 1, and illustrates means for rotating the mandrels and the articles carried thereby when adjacent the spray nozzles and a mandrel cleaning mechanism.

Referring first to FIG. 1 of the drawings, a novel apparatus or machine for coating hollow, tubular articles, such as can bodies, is generally designated by the reference numeral 25, and includes a main base 26 having an upper supporting plate 27 (FIG. 2) to which is welded a pair of upstanding plates 28, 30 (FIG. 3). A gear housing 31 is in turn supported upon a horizontally disposed plate 32 bridging the plates 28, 30 and welded thereto. The gear-housing 31 includes an upstanding vertical front plate 33 and houses intermeshed gears 34, 35 affixed to shifts 36, 37, respectively, which are in turn conventionally journalled for rotation in the housing 31. The shafts 36, 37 and other components associated therewith to be described immediately hereafter impart synchronous motion to an article infeed mechanism 38 (FIGS. 5 through 7) and an article transfer mechanism 40 (FIG. 7) of the apparatus 25. Each of the mechanisms 38 and 40 is supported by a common support mechanism 41 which is in turn supported by the housing 31.

Figure 6:
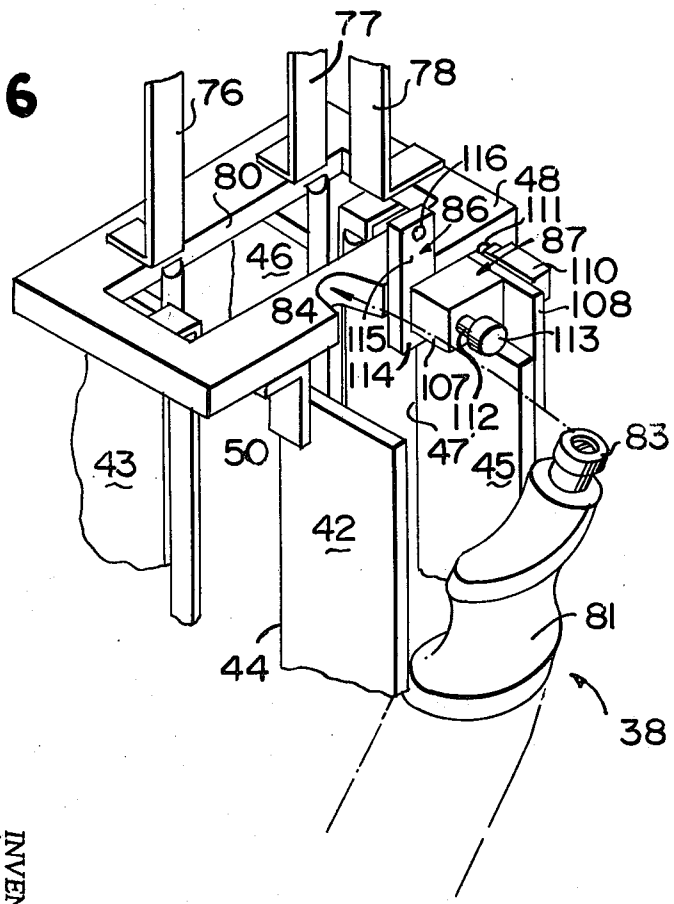
FIG. 6 is a fragmentary top perspective view of the feed screw and housing of FIG. 5, and illustrates the feed screw position in an inoperative position to remove jammed articles from the housing.
Figure 7:
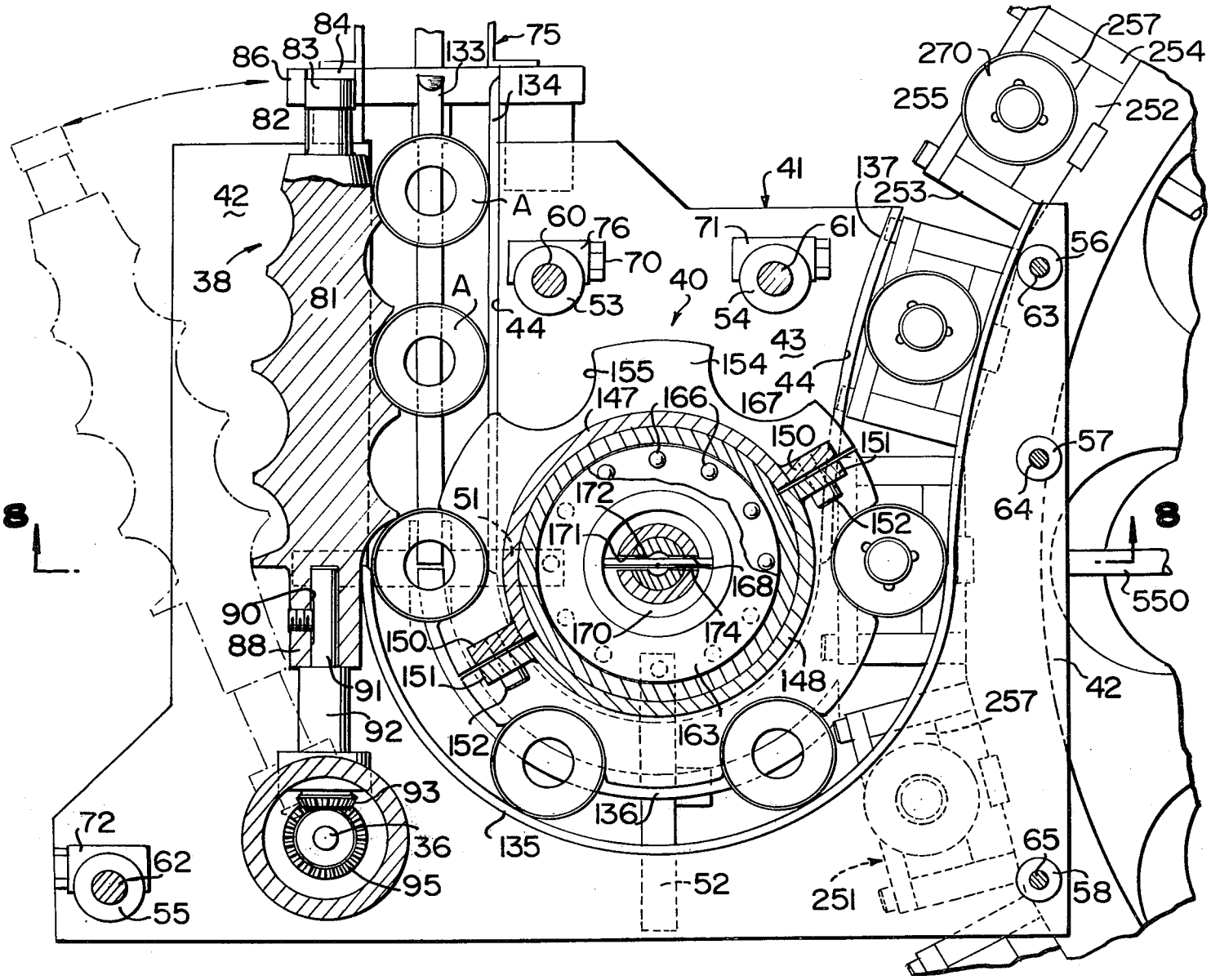
FIG. 7 is a fragmentary sectional view taken generally along line 7—7 of FIG. 5, and illustrates a clutch mechanism of the article transfer turret which terminates the rotation thereof upon article jamming.

The support mechanism 41 includes a pair of rear plates 42, 43, the latter of which is generally U-shaped in side elevation (FIG. 7) and defines with the former a generally U-shaped slot or track 44 (FIGS. 6, 7). The support mechanism 41 includes a correspondingly contoured U-shaped front plate 45 (FIGS. 3 and 6) and a plate 46 which defines with the plate 45 a generally U-shaped slot or track 47, the slot 47 being in alignment with the slot 44 (FIG. 6) to in part define an arcuate or U-shaped path of travel for articles A, such as metallic can bodies, in a manner to be described more fully hereafter.

The upper end portions (unnumbered) of each of the plates 42, 43, 45, and 46 are secured to a horizontal plate 48 by a plurality of generally identical L-shaped brackets 50 welded or otherwise secured between the plates 42, 43, 45, 46 and the underside (unnumbered) of the plate 48. The plates 42, 43 are additionally secured to each other by a pair of brackets 51, 52 (FIG. 7) which are welded to the outer faces (unnumbered) of the plates and are in bridging relationship to the slot 44. Similar brackets (not shown) are welded in the same manner to the outer faces of the plates 45, 46. The plate 43 is secured to the plate 46 by a pair of tubular sleeves 53, 54 which are welded to the inner faces (unnumbered) of these plates. The plates 42, 45 are similarly secured to each other by tubular sleeves 55 through 58 (FIG. 7) welded to the inner opposing faces (unnumbered) of these plates. In this manner the plates 42, 43, 45 and 46 define a rigid structure for supporting the mechanisms 38, 40 as will appear more fully hereafter.

The entire support mechanism 41 is supported by the gear-housing 31 by means of a plurality of parallel cylindrical rods 60 through 65 which are slidably received in the respective tubular sleeves 53 through 58 (FIG. 7). The ends (unnumbered) of the rods 60 through 65 which project away from the rear plates 42, 43 (FIG. 2) are fixed to tubular sleeves or brackets 66, 67, etc., which are welded or otherwise secured to the housing 31. The support mechanism 41 is fixedly but removably secured to the rods 60 through 62 by conventional transverse sleeves 70, 71 and 72 associated with the respective sleeves 60 through 62. A conventional tapered wedge having a threaded end portion is associated with each of the sleeves 70 through 72 and upon tightening nuts 73 associated therewith in a conventional manner the wedges (not shown) are brought into forceful binding engagement with the shafts or rods 60 through 62 to securely fix the supporting mechanism 41 in a desired position.

The articles are gravity-fed to the infeed mechanism 38 by means of a guideway 75 (FIG. 1) which is formed (FIGS. 5 through 7) of the infeed mechanism 38. The timing screw 81 includes an upper end portion 82 to which is freely rotatably secured a cylindrical or annular cam follower 83. The cam follower 83 is normally housed in a generally U-shaped slot 84 of the plate 48 (FIG. 6). The cam follower 83 is confined in the slot 84 of the plate 48 when the feed screw 81 is in its operative position (solid outlined in FIGS. 5 and 7) by a short moveable plate 86 (FIG. 6) of a jam detecting mechanism 87 which will be defined fully hereafter.

A lower end portion 88 of the feed screw 81 is provided with an axial bore 90 (FIG. 7) in which is received a reduced end portion 91 of a shaft 92. A gear 93 is fixed by conventional means (not shown) to a reduced end portion 94 of the shaft 92 and is in mesh with a gear 95 similarly conventionally fixed to a reduced end portion 96 of the shaft 36. Thus, as rotation is imparted to the shaft 36 the feed screw 81 is rotated in an appropriate direction to feed the articles downwardly and in timed relationship to the article transfer mechanism 40.

Means generally designated by the reference numeral 97 are provided for pivoting the feed screw 81 from its operative position (solid outlined in FIGS. 5 and 7) to an inoperative position (FIG. 6 and phantom outline in FIG. 7) to remove articles which may have become jammed during the feeding thereof by the feed screw 81. The means 97 includes a cylindrical sleeve 98 (FIG. 5) positioned between the plates 42, 45 in coaxial external relationship to the reduced end portion 96 of the shaft 36. The sleeve 97 includes a radial bore 100 in which is housed an annular flanged bearing retainer 101. Retainer 101 is welded or otherwise fixedly secured to the sleeve 98. A bearing assembly 102 surrounds the reduced end portion 94 of the shaft 92 and is confined in the position illustrated in FIG. 5 of the drawings to permit relative rotation between the shaft 92 and the retainer 101, and to also maintain the gear 93 in meshed relationship with the gear 95.

Figure 5:
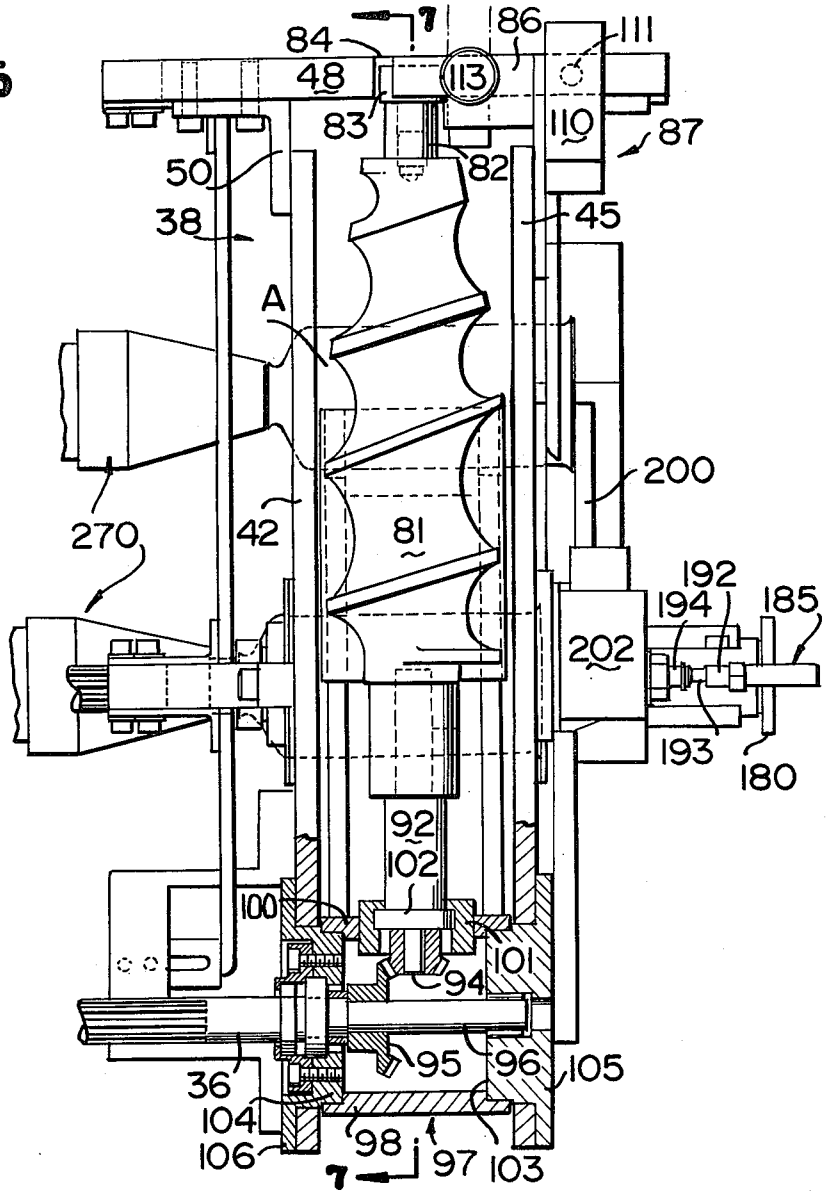
FIG. 5 is an enlarged fragmentary view partially in elevation and partially in section taken generally along line 5—5 of FIG. 3, and illustrates the pivotal mounting of the feed screw at a lower end portion and a jam detector associated with an upper end portion thereof.

The sleeve 98 includes axially opposite end portions (unnumbered) which surround cylindrical bosses 103, 104 of journals 10, 106, respectively, in which is conventionally journalled the end portion 96 of the shaft 36, in the manner clearly illustrated in FIG. 5 of the drawings. The journals 105, 106 are fixed to the respective plates 45, 42 by means of suitable fasteners, but the sleeve 98 is free to rotate relative to the bosses 103, 104 in both clockwise and counterclockwise directions as viewed in FIG. 7 of the drawings.

Should article jamming occur during the feed of the articles by the feed screw 81, the short plate 86 is moved from the position shown in FIG. 7 to the position illustrated in FIG. 6 to release the cam follower 83 from its normal position confined in the slot 84 whereupon the feed screw 81 is free to pivot from the solid line position to the phantom outline position in FIG. 7. Jammed articles may then be readily and quickly removed and the feed screw 81 thereafter pivoted back to its initial position and locked in place by the plate 86. It should be noted that during the pivoting movement of the feed screw 81 the sleeve 98 rotates relative to the bosses 103, 104 of the journals 105, 106, respectively, and that the gears 93, 95 remain at all times in mesh with each other.

The jam detecting mechanism 87 includes a rectangularly-shaped housing 107 fixed to a plate 108 (FIGS. 5 and 6), and the plate 108 is in turn welded or otherwise fixed to an upper portion (unnumbered) of the front plate 45. A switch 110 is fixed to an opposite face of the plate 108 and includes a slidable switch arm 111 normally biased to an outermost projected position by a spring (not shown). A shaft 112 is rotatably mounted in the housing 107 and includes a knob 113 at an end portion (unnumbered) thereof. An opposite end portion (unnumbered) of the shaft 112 passes through a bore (unnumbered) of the plate 86 and is received in a recess 119 (FIG. 8) of the plate 48. The plate 86 is fixed to the shaft 112 and can therefore be moved between the closed and open positions (FIGS. 5 and 6 respectively) by manually rotating the knob 113. A spring (not shown) in the housing 107 at all times biasingly urges the plate 86 into contact with the opposing face, (unnumbered) of the plate 48. The plate 86 includes an end portion 114 which in the operative position thereof partially closes the slot 84 (FIG. 5) to confine the cam follower 83 of the feed screw 81 therein, while an opposite end portion 115 of the plate 86 includes a shallow circular recess 116 which receives the end of the sliding switch arm 111 of the switch 110 (FIG. 5).

Assuming the plate 86 is in the position illustrated in FIG. 5 with the end portion 114 confining the cam follower 83 in the slot 84 with the switch arm 111 seated in the recess 116, any article jamming which may occur will tend to force the feed screw 81 outwardly of the slot 84. This outward movement of the feed screw 81 is possible because of the pivotal mounting of the feed screw 81 heretofore described. As the feed screw 81 pivots outwardly the cam follower 83 urges the plate 86 outwardly against the biasing force of the spring (not shown) in the housing 107. This same outward movement of the plate 86 moves the switch arm 111 of the switch 110 to the right as viewed in the FIG. 6 until the switch contacts (not shown) are broken to open the main drive circuit (not shown) of the apparatus whereupon a main drive motor M (FIG. 2) is de-energized and the timing or feed screw is stopped. The knob 113 may then be grasped to pivot the plate 86 to the position shown in FIG. 6 to remove the jammed articles in the manner heretofore described after which the cam follower 83 is again positioned in the slot 84 and the knob 113 is rotated to position the portion 114 of the plate 86 in partial overlying relationship to the cam follower 83 and the switch arm 111 in the recess 116. The main drive circuit is then re-energized to continue the feed of the articles by the timing screw 81.

The drive connection between the main motor M and the drive shaft 36 is best illustrated in FIG. 2 of the drawings, and includes a pulley belt 117 entrained about a pulley 118 fixed to a shaft 120 of the main motor M. The pulley belt 117 is similarly entrained about a pulley 121 fixed to an input shaft 122 of a gear mechanism 123. The gear mechanism 123 is of a conventional construction and includes two output shafts 124, 125, the latter shaft of which is coupled to a clutch plate 126 of a clutch mechanism 127 by a clutch disengaging mechanism 128 which will be described fully hereafter. Another clutch plate 130 is fixed to a shaft 131 which is in turn journalled for rotation in a conventional gear housing 132 having a plurality of gears (not shown) in meshed relationship for imparting rotation to the shaft 36 upon the rotation of the shaft 131 when the clutch plates 126, 130 are engaged, as shown in FIG. 2 of the drawings.

In order to insure smooth movement of the articles A by the mechanisms 38 and 40 and to prevent the articles from accidentally falling out of the U-shaped slot of the support mechanism 41, suitable guide means (FIG. 7) in the form of guide rods 133 through 137, etc., are welded to various plates and brackets of the supporting mechanism 41 to confine the articles A during their movement therethrough. Only those guide rods associated with the plates 42, 43 are illustrated in FIG. 7 of the drawings, but it is to be understood that similar guide rods are arranged in a like manner relative to the plates 45 and 46 to effect the movement of the articles A along the generally U-shaped path of the support mechanism 41.

Figures 8, 11:
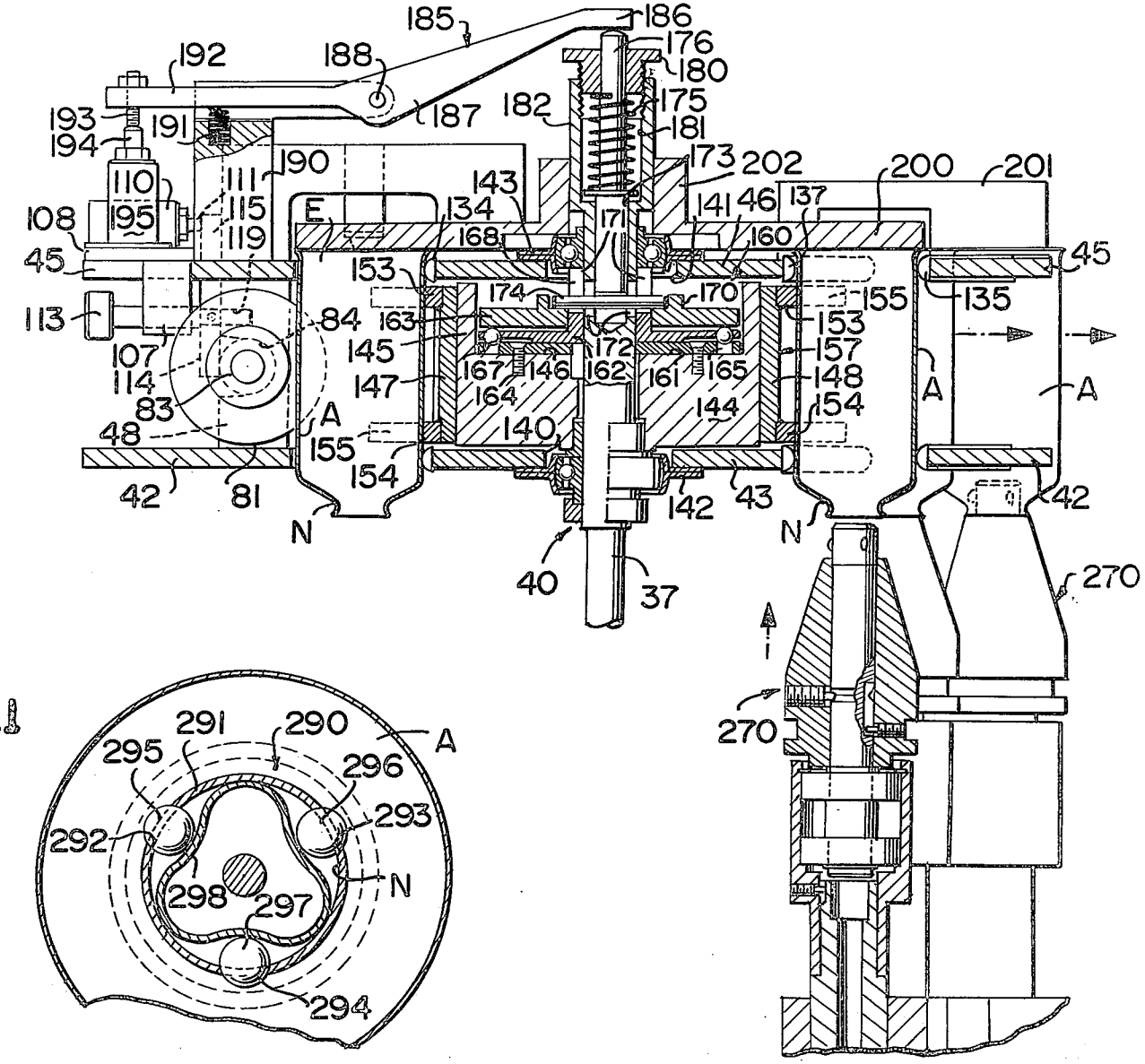
FIG. 8 is a fragmentary sectional view taken generally along line 8—8 of FIG. 7, and more clearly illustrates the clutch mechanism, a detector associated with the clutch mechanism, and the details of one of the mandrels of the main conveyor.
FIG. 11 is a highly enlarged sectional view taken generally along line 11—11 of FIG. 10, and more clearly illustrates the clamping means of the mandrel including biased balls internally engaging the article.

The article transfer mechanism 40 to which the articles A are transferred from the feed screw 81 is best illustrated in FIGS. 7 and 8 of the drawings, and is generally a turret-type mechanism which is journalled for rotation in apertures 140, 141 of the respective plates 43, 46, (FIG. 8). The shaft 37 of the mechanism 40 passes through the apertures 140, 141 and portions thereof are embraced by anti-friction bearings (unnumbered) in bearing housings 142, 143, which include flanges (unnumbered) welded or otherwise secured to outermost faces (unnumbered) of the respective plates 43, 46. An annular body 144 loosely surrounds the shaft 37 and a circumferential flange 145 thereof defines with the shaft 37 an annular recess 146. Two semi-cylindrical members 147, 148 (FIG. 7) surround the exterior of the annular body 144 and include radially outwardly directed flanges 150, 151, respectively, which are secured to each other by conventional bolts 152 to clamp the members 147, 148 to the annular body 144. The members 147, 148 each carry a pair of radially outwardly directed parallel flanges 153, 154 having semi-circular article-receiving pockets 155 (FIG. 7) into which the articles A are introduced by the feed screw 81.

The body 144, the semi-cylindrical members 147, 148 and the parallel plates 153, 154 define a turret generally designated by the reference numeral 157 which is driven by the shaft 37 through a disengageable clutch mechanism 160.

The clutch mechanism 160 includes a generally circular apertured driven disc 161, a similar driving disc 162 and a clutch disc 163 housed in the recess 146 in external telescopic relationship to the shaft 37. The driven disc 161 is secured to the body 144 of the turret mechanism 157 by a plurality of bolts 164, and includes a plurality of equally spaced circumferentially disposed apertures or openings 165 (FIG. 8). The driving disc 162 includes an identical number of apertures 166 (FIG. 7) each of which retains an associated ball 167. The apertures 165, 166 and the balls 167 are normally in interlocked driving relationship (FIG. 8) but upon the jamming of articles the balls 167 move out of the apertures 165 to terminate the rotation of the turret mechanism 157 as will appear more fully hereafter.

The clutch disc 163 is also in external telescopic relationship to a tubular portion 168 of the driving disc 162 and includes an annular rib 170 projecting axially away from the disc 161, 162 (FIG. 8). The portion 168 of the driving disc 162 includes a pair of diametrically opposed notches 171 which are in alignment with a similar pair of notches 172 of the shaft 37 which open into an axial bore 173 of the shaft 37. Pin means 174 passes through the pairs of notches or apertures 171, 172 and axially opposite end portions (unnumbered) of the pin 174 are housed in the annular recess (unnumbered) defined between the axially projecting annular flange 170 of the disc 163 and the tubular portion 168 of the disc 162. The pin 174 is thereby prevented from being accidentally removed from the apertures 171, 172 in a radial direction.

As the shaft 37 rotates the pin 174 is similarly rotated by the engagement of the latter with the walls defining the apertures 172. Rotation of the pin 174 imparts rotation to the disc 162 and through the interengaged balls 167 and the openings 165, 166 to the body 144 and the components fixed thereto, thereby rotating the turret mechanism 157 as long as the clutch plate 163 is in the position illustrated in FIG. 8 of the drawings. However, should the articles A become jammed and the body 144 become retarded in its rotation by the jamming forces, the rotation of the driving disc 162 causes the balls 167 to move outwardly of the apertures 165 causing the disengagement of the discs 161, 162. This same movement of the balls 167 outwardly of the apertures 165 causes the clutch plate 163 to move toward the plate 46 against the biasing force of a spring 175 surrounding a rod 176 having a lower end portion (unnumbered) slidingly received in the bore 173 and in contact with the pin 174. The spring 175 thereby normally urges the rod 176, the pin 174 and the clutch plate 163 toward the plate 173 (FIG. 8) but upon article jamming disengagement of the balls 167 and the apertures 165 is effected against the force of the spring 175.

The disengagement between the driving and driven discs by the movement of the clutch disc 163 against the biasing force of the spring 175 can be regulated to effect disengagement at a pre-determined force of retardation tending to stop the rotation of the turret mechanism 157. This regulation of the clutch mechanism 160 is effected by tightening or loosening a nut 180 which loosely surrounds the rod 176 and is in threaded engagement with an interior threaded portion (unnumbered) of a counterbore 181 formed in an enlarged portion 182 of the shaft 37. As the nut 180 is threaded inwardly the spring 175 is compressed to increase the biasing force of the rod 176 upon the clucth disc 163 through the pin 174, while opposite rotation of the nut 180 reduces the biasing force of the spring 175. Thus, by regulating the force exerted upon the disc 163 by adjusting the tension of the spring 175 the balls 167 and the apertures 165 may be disengaged by any pre-determined retardation force imposed upon the turret mechanism 175 upon the partial or total jamming of articles A being conveyed thereby.

The clutch mechanism 160 also includes jam detecting means 185 for cutting off power to the shaft 37 upon the disengagement of the clutch mechanism to prevent rotation of the turret 157. The detecting mechanism 185 is defined in part by the pin 174 and the rod 176 which normally engages an end portion 186 of a pivotally mounted lever 187. The lever 187 is pivoted at 188 (FIG. 8) to a generally L-shaped bracket 190 (FIGS. 2 and 8) which is in turn welded or otherwise conventionally secured to an upper portion of the plate 45. A compression spring 191 housed in a bore (unnumbered) of the bracket 190 bears against an opposite end portion 192 of the lever 187 and continuously biases the latter in a clockwise direction as viewed in FIG. 8 of the drawings. An adjustable pin 193 carried by the end portion 192 of the lever 187 normally engages a switch arm 194 of a switch 195 secured to the plate 108. The contacts (not shown) of the switch 195 are normally closed in the projected position of the switch arm 194 (FIG. 8) and are in the main drive circuit (not shown) of the apparatus.

When the turret 157 is being rotated by the shaft 37 in the absence of article jamming the rod 176 remains axially motionless and the spring 191 maintains the lever 187 in the position illustrated in FIG. 8 to maintain the contacts of the switch 195 closed and the motor M energized. However, should an article jam and the clutch disc 163 begin to move away from the driving disc 162, this movement causes axially outward movement of the rod 176 through the aperture (unnumbered) of the nut 180. Axial outward movement of the rod 176 causes counterclockwise pivoting movement of the lever 187 as viewed in FIG. 8 of the drawings which in turn pushes the switch arm 194 into the switch housing (unnumbered) to open the contacts and de-energize the motor M.

The article transfer mechanism 140 also includes a generally circular rotary back-up plate 200. (FIGS. 3 and 8) An axially projecting portion 202 of the rotary back-up plate 200 surrounds and is attached to the enlarged portion 182 of the shaft 37 (FIG. 8). The purpose of the back-up plate 200 is to support open end portions E of the articles A during the transfer of the articles A from the turret 157 to a main turret-type conveying mechanism 205. A U-shaped bracket 201 connects an outermost portion of the plate 45 to a central portion thereof and acts as a brace for the outermost portion.

Figure 4:
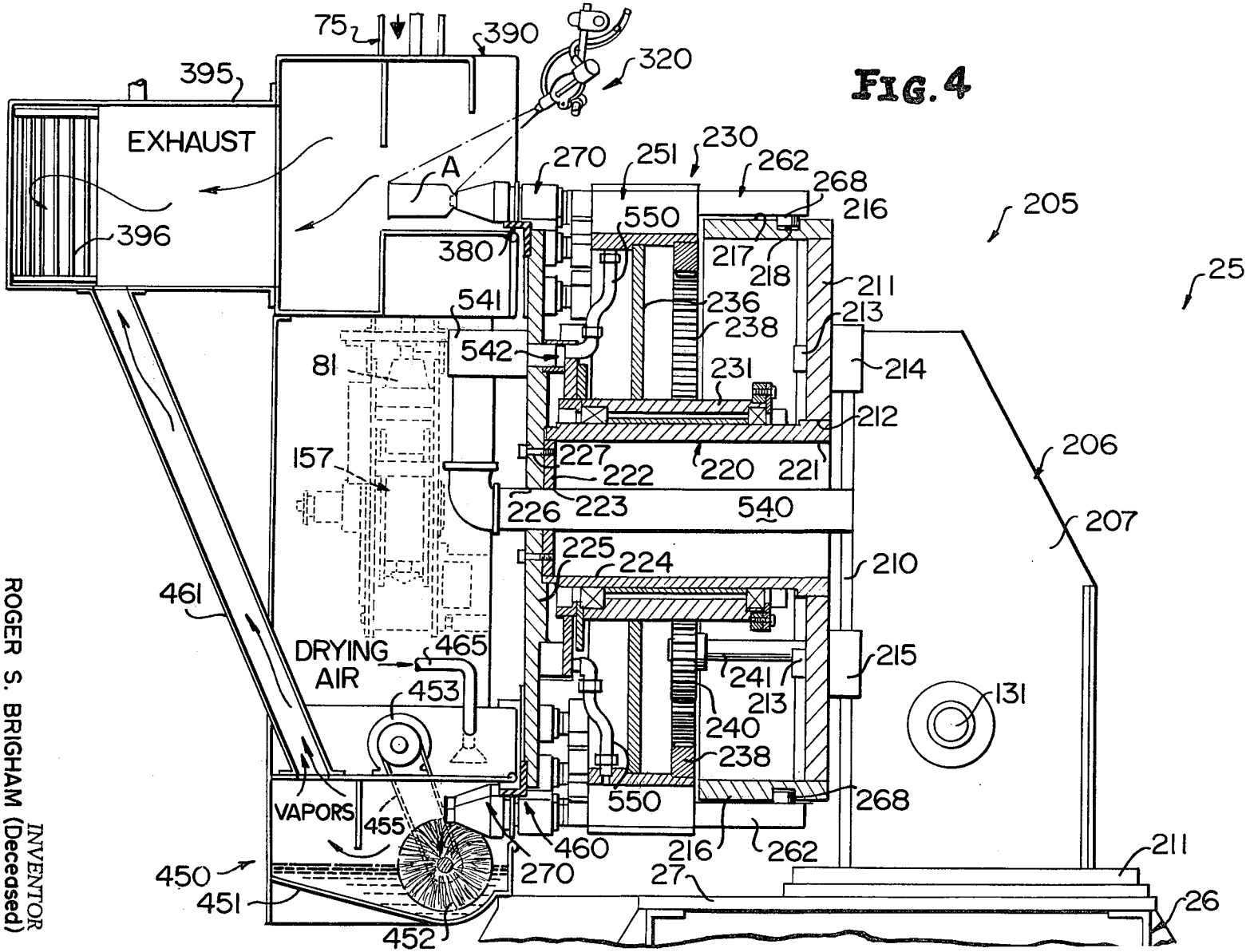
FIG. 4 is a fragmentary sectional view taken generally along line 4—4 of FIG. 2, and illustrates exhaust means associated with the spraying and mandrel cleaning stations and the drive for the main conveyor.

The main conveying mechanism 205 is best illustrated in FIGS. 2 and 4 of the drawings, and includes a vertical pedestal 206 defined in part by upstanding parallel walls 207, 208 (FIG. 2), a vertical plate 210 and a base 211 fixed to the plate 27 of the base 26. A rear annular plate 211 having a circular aperture 212 is secured by a plurality of bolts 213 to horizontal cross bars 214, 215 which are welded to the pedestal 206. A tubular member 216 surrounds the annular plate 211 and is secured thereto by welding or other conventional means. An outer portion 217 of the tubular member 216 is provided with an endless cam or guidetrack 218 (FIGS. 4 and 15) which functions in a manner to be described fully hereafter. Another tubular member 220 (FIG. 4) has an axial end portion 221 received in the bore 212 of the plate 211 and is permanently fixed thereto. An annular plate 222 having an aperture 223 is received in an opposite axial end portion 224 of the member 220 and is similarly permanently fixed to the latter. A circular front plate 225 (FIG. 3) having a central aperture 226 (FIG. 4) in alignment with the aperture 223 is fixed by bolts 227 to the plate 222 of the tubular member 220. The plate 225 is thereby supported by a vertical plane parallel to the plate 211 and the former may be provided with a plurality of circular openings 228 (FIG. 3) to lighten the front plate 225 without appreciably weakening the same.

The tubular member 220 rotatably supports a turret mechanism, generally designated by the reference numeral 230 for rotation about a horizontal axis. The turret mechanism 230 (FIGS. 4 and 18) includes a cylindrical hub 231 exteriorly surrounding the tubular member 220 and freely rotatable relative thereto. Conventional antifriction bearing assemblies 232, 233, and associated annular bearings retainers and seals 234, 235 (FIG. 18) may be associated with the hub 231 in a conventional manner. An annular plate 236 exteriorly surrounds the hub 231 and is fixed thereto while a cylindrical member 237 is fixed to the peripheral edge portion (unnumbered) of the annular plate 236. An internally toothed ring gear 238 surrounds the hub 231 and is fixed to the cylindrical member 237. The ring gear 238 is in mesh with a gear 240 carried by a shaft 241 which passes through suitable openings in the plates 211, 210, and is coupled by conventional gearing (not shown) to the shaft 131 (FIG. 2). In this manner rotation imparted to the shaft 241 rotates the gear 240 and the turret mechanism 230 in a clockwise direction as viewed in FIGS. 2 and 3 of the drawings in timed relationship with the movement of articles conveyed by the article in-feed mechanism 38 and the article transfer mechanism 40.

The turret mechanism 230 carries a plurality of identical article supporting means 250 (FIGS. 3, 7, 9, 12 and 18) which are equally circumferentially spaced about the periphery of the turret mechanism 230, as is best illustrated in FIG. 3. Each of the supporting means 250 includes a housing 251 defined by a base plate 252 secured to the cylindrical member 237, a pair of spaced side plates 253, 254 (FIG. 12) and a top plate 255 secured to the plates 253, 254 by conventional bolts 256. Each housing 251 also includes a front plate 257 (FIGS. 12 and 18) having a rectangular aperture 258 and a rear plate 260 having a similar aperture 261. The apertures 258, 261 define guide means for a reciprocal mandrel-carrying member 262 associated with each of the housings 251.

Each mandrel-carrying member 262 is reciprocally mounted relative to an associated one of the housings 251 and includes an end portion 263 in overlying relationship to the tubular member 216 and a reduced axially opposite end portion 264. In accordance with an embodiment of the invention to be described more fully hereafter, each mandrel-carrying member 262 includes an axial bore 265 and a radial port 266 (FIG. 18) opening into a chamber 267 of each housing 251 which is adapted to be placed into fluid communication witha vacuum source in a manner to be described hereafter.

Figure 10:
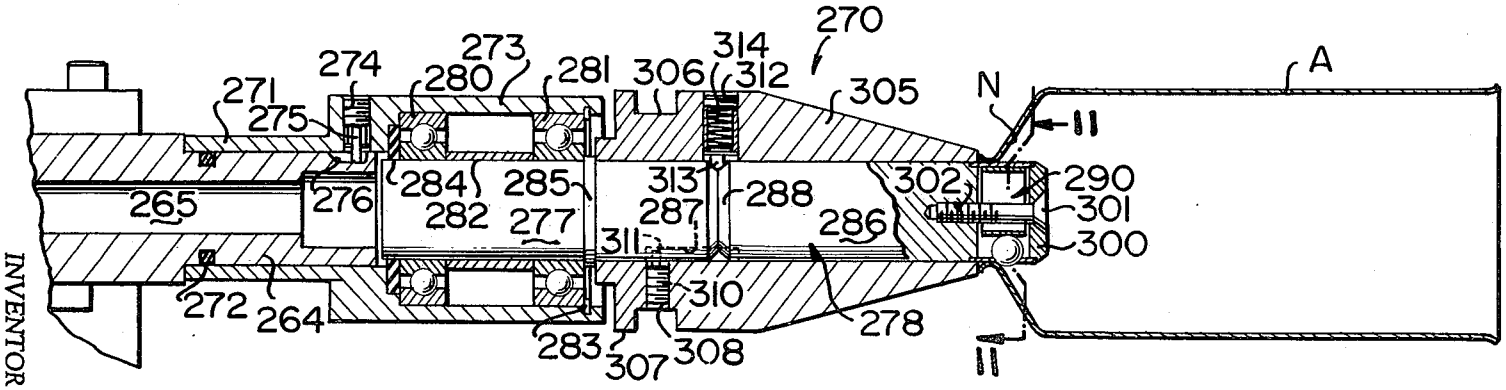
FIG. 10 is an enlarged fragmentary sectional view taken generally along line 10—10 of FIG. 9, and illustrates means for clamping an associated article to its mandrel.
Figure 14:
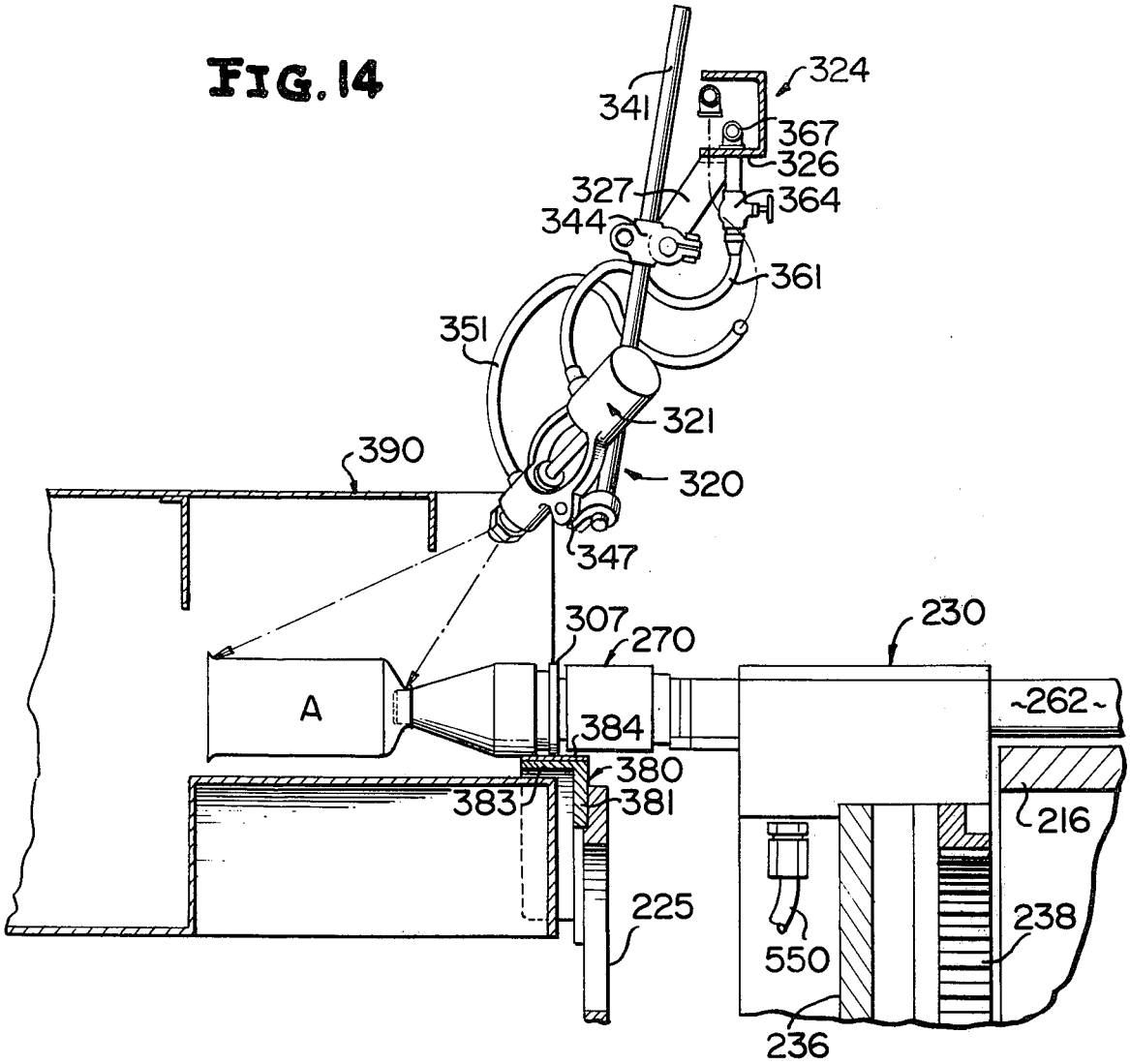
FIG. 14 is a fragmentary sectional view taken generally along line 14—14 of FIG. 12, and more clearly illustrates the means for rotating the mandrels during a coating operation.

The end portion 263 of each of the mandrel-carrying members 262 includes a cam follower 268 received in the cam track 218 of the tubular member 216 to control the reciprocal movement of each of the mandrel-carrying members 262 during the operation of the turret mechanism 250 as will appear more fully hereafter. The opposite reduced end portions 264 of each mandrel-carrying member 262 include an article supporting mandrel, generally designated by the reference numeral 270 (FIG. 10). Each article supporting mandrel 270 includes a sleeve 271 (FIG. 10) surrounding the reduced end portion 264 with an O-ring seal 272 positioned in a radially outwardly opening circumferential groove (unnumbered) of the reduced end portion 264. Each sleeve 271 includes a cylindrical portion 273 having a radial threaded aperture 274 into which is threaded a set screw 275. The set screw 275 is received in a notch 276 of the reduced end portion 264 to removably secure the cylindrical portion 273 thereto. An end portion 277 of a shaft 278 is received in the cylindrical portion 273 and is mounted for rotation therein by anti-friction bearing assemblies 280, 281. The bearing assemblies 280, 281 are retained in the cylindrical portion 273 by a cylindrical sleeve 282 and a retainer 283 in the manner clearly apparent from FIG. 10 of the drawings. An annular seal 284 is positioned between the bearing assembly 280 and an annular shoulder (unnumbered) of the cylindrical portion 273 for a purpose which will be more apparent with respect to other embodiments of this invention.

The shaft 278 of each article supporting mandrel 270 includes an annular peripheral flange 285 and another end portion 286 to the right of the flange 285 as viewed in FIG. 10. The end portion 286 of each shaft 278 is provided with an outwardly opening axially extending groove or slot 287 and a radially outwardly opening circumferential groove or slot 288. Article supporting or clamping means generally designated by the reference numeral 290 are carried by the end portion 286 of each shaft 278. Each clamping means 290 (FIG. 11) includes a cylindrical sleeve 291 having three circular openings 292 through 294 formed therein. Each of the openings is smaller than the diameter of an associated ball 295 through 297, respectively. The balls 295 through 297 are partially received in the openings 292 through 294, respectively, and are urged radially outwardly by a generally triangularly-shaped endless spring 298, as is best illustrated in FIG. 11 of the drawings. A cap 300 (FIG. 10) and a bolt 301 threadedly received in a threaded axial bore 302 maintains the elements 291 and 295 through 298 in assembled relationship upon the end portion 286 of each of the shafts 278.

The clamping means 290 functions to internally grip or clamp each article A upon the introduction of the clamping means 290 into necks N of the articles A through an associated opening (unnumbered). As each clamping means 290 is inserted into an associated neck N of article A in a manner to be described more fully hereafter, the neck N urges the balls 295 through 297 radially inwardly against the biasing force of the spring 298. After the balls 295 through 297 pass through the neck N the spring 298 urges the balls 295 through 298 radially outwardly to clampingly engage interior surfaces of the article necks, in a manner best illustrated in FIG. 10 of the drawings.

Each of the article supporting mandrels 270 also includes a reciprocal sleeve 305 surrounding the end portion 286 of the shaft 278 (FIG. 10). Each reciprocal sleeve 305 includes a circumferential radially outwardly opening groove 306 which in part defines a radially outwardly directed circumferential flange 307. A set screw 310 is threadably secured in a threaded radial bore 308 of each sleeve 305, and an end portion 311 of each set screw is received in the axial slot 287 of its associated shaft 278. This coupling between each sleeve 305 and its associated shaft 278 permits relative reciprocal movement therebetween but prevents relative rotational movement for a purpose to be described more fully hereafter.

The sleeve 305 of each article supporting mandrel 270 includes another radial bore 312 in which is received a pin or detent 313 biased radially inwardly by a spring 314. In the position of the sleeve 305 and the shaft 278 illustrated in FIG. 10 the detent 313 is in engagement with the groove 288 to prevent relative reciprocal movement between the shaft 278 and the sleeve 305. However, the detent 313 is free to move radially outwardly against the force of the spring 314 to effect disengagement between the detent and the groove 288 whereupon relative reciprocation between the shaft 278 and the sleeve 305 is permitted.

Figure 9:
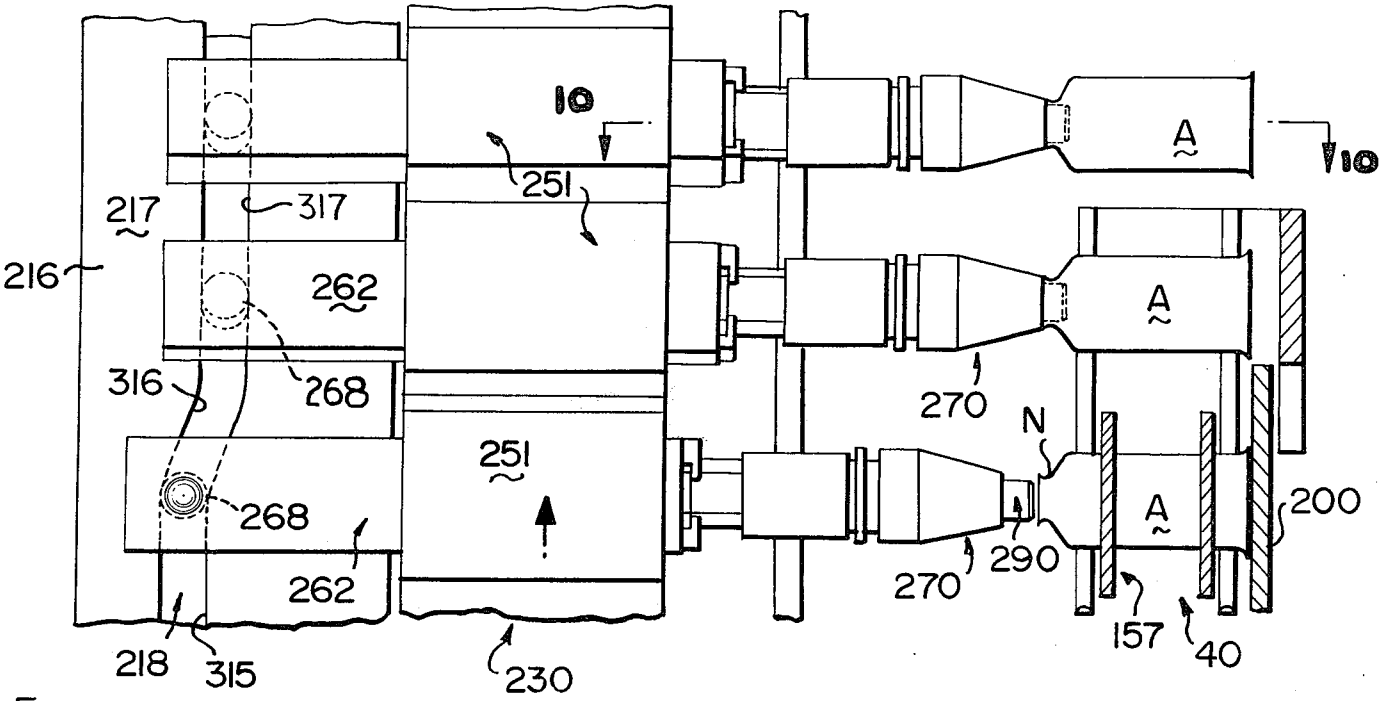
FIG. 9 is a fragmentary side elevational view taken generally along line 9—9 of FIG. 3 and illustrates one of a plurality of mandrels prior to its receiving an article thereon.

Referring to FIG. 9 of the drawings in particular, it will be noted that adjacent the point of transfer between the turret mechanism 157 and the turret mechanism 230 the article supporting mandrels 270 are maintained in axial alignment with the pockets 155 and in axial spaced relationship to the article necks N, as is best illustrated by the lowermost article supporting mandrel 270 of FIG. 9. This axial spaced relationship is maintained during the travel of the article carrying mandrels by the confinement of the cam followers 268 in a cam track portion 315 of the cam track 218. However, as the article supporting mandrels 270 are moved by the turret mechanism 230 in the direction of the unnumbered headed arrow in FIG. 9 the cam followers 268 travel in a cam track portion 316 of the cam track 218 which progressively moves the mandrel carrying members 262 to the right as viewed in FIG. 9 thereby introducing the clamping means 290 into each article neck N and securing each article A to an associated mandrel. After the articles A have been secured to the mandrels 270 the articles A are progressively transferred by the turret mechanism 230 to a spraying or coating station 320 (FIGS. 2, 4, 12 and 14). Axial movement of the mandrels 270 during the movement thereof through the spraying station 320 is prevented by the confinement of each cam follower 268 in a cam track portion 317 (FIGS. 2 and 9). Three identical nozzles 321 through 323 are supported above the turret mechanism 230 at the spraying station 320 by a support structure 324 which includes a generally C-shaped beam 325 (FIG. 14) to a lowermost web 326 of which is secured a pair of brackets 327, 328 and a bridging member 340. Nozzle support rods 341 through 343 are secured to the bridging member 340 by conventional couplings 344 through 346 which can be selectively adjustably secured at any position along the bridging member 340 and/or the rods 341 through 343 in a well-known manner. The spray nozzles 321 through 323 are secured to the respective rods 341 through 343 by adjustable pivotal connections 347 through 349 which permit the nozzles to be securely adjusted in a pre-determined position as indicated by the unnumbered headed arrow associated with the nozzle 323.

The nozzles 321 through 323 are selectively coupled to a source of coating or spraying material, such as lacquer or paint, by respective flexible conduits 351 through 353, valves 354 through 356 and a main header or pipe 357. The nozzles 321 through 323 are also connected to a control mechanism 360 (FIG. 1) by means of respective flexible conduits 361 through 363, valves 364 through 366 and conduits 367 through 369. Each of the conduits 367 through 369 is connected to an individual solenoid actuated air valve, such as the solenoid valve 370 associated with the conduit 367. A solenoid 371 of the valve 370 as well as solenoids of the remaining unillustrated valve is connected to a conventional rotary timer 372 having a drive shaft 373 for rotating three switch arms (unnumbered). The rotary timer 372 of the control mechanism 360 is supported on the gear housing 132 (FIG. 2) and is driven by conventional gearing from the shaft 131. As the shaft 373 of the timer 372 is rotated the contact arms selectively energize and de-energize the various air valves to sequentially operate the spray nozzles 321 through 323, as will appear more apparent hereafter.

Reference is now made to FIG. 12 and the spray nozzle 321 which includes a chamber or housing 380 in which is reciprocally mounted a piston 381 biased outwardly as viewed in FIG. 12 by a spring 383. A piston rod secured to the piston 381 projects outwardly of the housing 380 and an end portion thereof carrying a valve 384 is positioned in a housing or chamber 385. The conduit 361 from the control mechanism 360 is connected to the chamber 380 while the conduit 351 in fluid communication with the source of coating material is placed in fluid communication with the chamber 385. In the off or closed position of the nozzle 321, as well as the identical nozzles 322, 323, the spring 382 forces the valve 384 downwardly from the position illustrated in FIG. 12 to prevent the coating material from entering the chamber 385 and being sprayed outwardly therefrom. However, when the contact of the rotary timer 372 closes the circuit of the solenoid 371 and connects the valve 370 to a source of air pressure, the air admitted into the chamber 380 moves the piston against the biasing force of the spring 382, opens the valve 384 and spraying takes place.

The operation of the control mechanism 360 is such that as the articles A pass through the coating station 320 the nozzles 321 through 323 are selectively energized and de-energized to coat selected circumferential surface portions of each article without spraying between the articles in a manner schematically illustrated in FIG. 13 of the drawings. As any particular article A (FIG. 13) approaches the first or leading spray nozzle 321 the nozzle 321 is energized to coat a circumferential surface portion S1 as the article is moved by the nozzle 321 and rotated about its own axis, in a manner which will be described immediately hereafter. Prior to the termination of the spray from the first nozzle 321 the second nozzle 322 is energized by the control mechanism 360 to coat a second circumferential surface S2 of the article A. Since the spray from the first nozzle is not terminated prior to the initiation of spraying by the second nozzle a limited portion of both surface portions S1 and S2 is overlappingly sprayed with coating material from both nozzles 321 and 322, and is therefore provided with an overlapped coating 01. The third nozzle 323 is activated prior to the termination of the spray by the second nozzle 322 to coat a third circumferential surface portion S3 and overcoat a double coat a portion 02 and a portion 03 thereby completing the spraying or coating of the entire exterior surface of the article A of FIG. 13 and each article passing through the coating station 320.

As the mandrels 270 pass through the coating station 320, the same rotated in the direction of the unnumbered headed arrows in FIG. 12 by a mechanism 380 which includes a plate 381 secured by bolts 382 to the front plate 225. A curved forwardly directed flange 383 of the plate 381 underlies the flange 370 (FIG. 14) of each of the mandrels 270. A strip of material 384 having a high coefficient friction overlies the flange 383 and contacts the periphery of each flange 307 as the mandrels 270 move in an arcuate path from left to right as viewed in FIG. 12 thereby imparting rotation to the mandrels and the articles A through the spraying station 320.

The strip 384 is secured at an end portion 385 thereof to the plate 225 while an opposite end portion 386 is connected to a circular ratchet wheel 387 by means not shown to the plate 225. A pivotally mounted spring biased locking pawl 388 prevents the ratchet wheel 387 from rotating counterclockwise (FIG. 12) but any slack in the strip 381 can be taken up by rotating the ratchet wheel 387 in a clockwise direction as viewed in this same figure.

An exhaust hood 390 (FIGS. 4, 12 and 14) is located at the spraying station and includes side panels 391, 392 (FIG. 12) provided with suitable apertures 393, 394 through which the articles A and portions of the mandrels 270 pass during the movement thereof through the spraying station. A main exhaust header 395 (FIGS. 1 and 4) is connected to the exhaust hood 390 and includes a fan 396 driven by an appropriately energized electric motor 397.

After the articles A have been sprayed or coated the same are transferred to a take-away conveyor mechanism 400 (FIGS. 1 through 3, 15 and 16). The conveyor mechanism 400 includes a drive gear 401 fixed to a shaft 402 which is rotatably mounted in a journal block 403 of a support 404, and is fixedly secured to the shaft 124 (FIG. 2) by a conventional coupling 405. An endless chain 406 is entrained about the gear or sprocket 401, and similar but non-driven idler sprockets 407, 408 and other gears or sprockets (not shown) in an oven 410 into which the articles A are transferred and dried or cured. The articles A are carried by pins or rods 411 (FIGS 2 and 15) having non-marring tips 412. The run (unnumbered) of the endless chain 406 remote from the oven 410 (FIG. 1) is so located as to bring the elements 411 into temporary alignment with the articles A and the mandrels associated therewith, as is best illustrated in FIGS. 1 and 3 of the drawings, during which time the articles A are transferred from the main conveyor 205 to the take-away conveyor 400.

Figure 16:
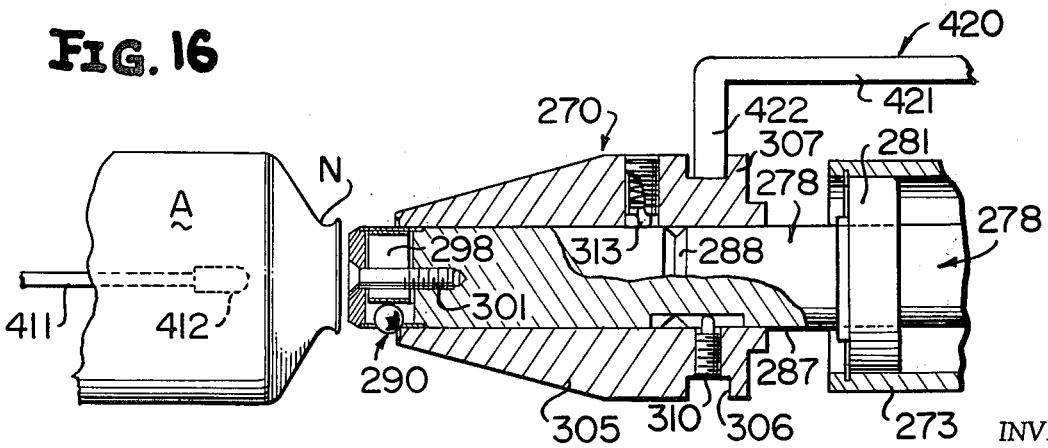
FIG. 16 is an enlarged sectional view taken generally along line 16—16 of FIG. 15, and more clearly illustrates the mechanism for disengaging the clamping means.
Figure 15:
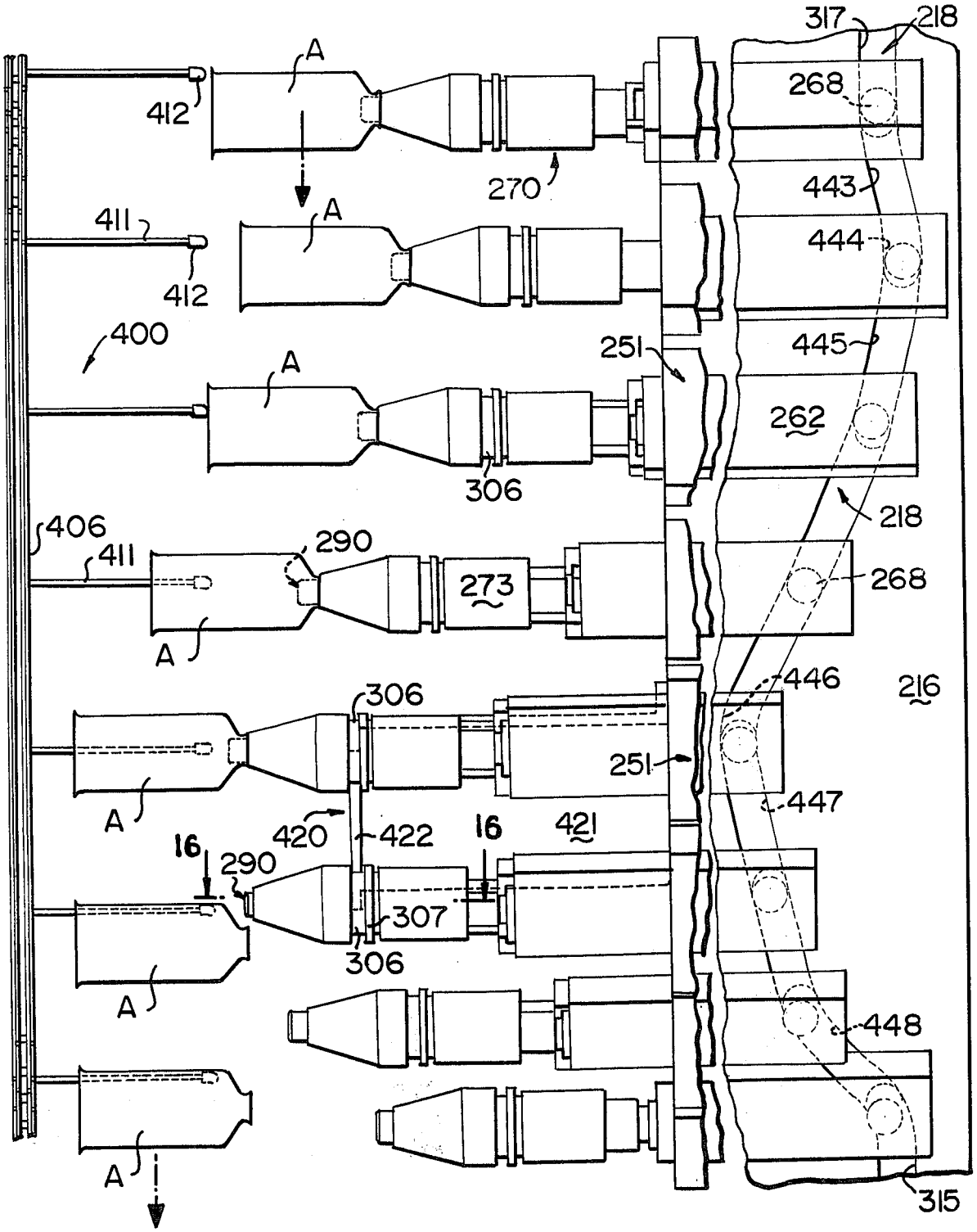
FIG. 15 is a fragmentary enlarged side elevational view taken generally along line 15–15 of FIG. 3, and illustrates cam means for reciprocating the mandrels during the transfer of articles from the mandrels to the take-away conveyor, and means for disengaging the article clamping means.

The transfer of the articles A takes place by the cooperative reciprocation of the mandrel-carrying members 262 which reciprocate each article supporting mandrel 270, as well as the relative reciprocation between the shaft 278 and the sleeve 305 of each mandrel 270 by the respective cam track 218 and a cam or guide mechanism 420 (FIGS. 1, 15 and 16). The cam mechanism 420 includes a plate 421 which is welded or otherwise secured to the front plate 225 of the turret mechanism 205. The plate 421 includes a flange 422 adapted to be received in each groove 306 of the mandrels 270.

Referring to FIG. 15 of the drawings, as the mandrels 270 are moved in synchronism with the rods 411 of the take-away conveyor 400 the cam follower 268 passes beyond the cam track portion 317 of the cam track 218 to a cam track portion 443 which is inclined away from the take-away conveyor 400 and causes movement of the mandrels 270 to the right (FIG. 15) to provide appreciable axial clearance between the articles and the rods 411 prior to the intersection of the paths of travel of each. The articles A and the rod 411 become progressively aligned as each cam follower 268 travels along a cam track portion 444 of the cam track 218. Thereafter the cam followers 268 are guided in a cam track portion 445 of the cam track 218 which is inclined toward the take-away conveyor 400 and progressively urges each mandrel-carrying member 262, the mandrel 270 associated therewith and the respective article toward the rods 411 during which time an associated rod 411 enters an associated article A. At an end portion 446 of the cam track 218 the groove 306 of each mandrel 270 is in alignment with the flange 422 of the cam mechanism 420 and registers therewith in the manner illustrated in FIG. 16 of the drawings. As each cam follower 268 moves from the portion 446 of the cam track 218 along a cam track portion 447 inclined away from the take-away conveyor 400 the mandrel-carrying member 262 and the shaft 278 thereof is drawn to the right as viewed in FIG. 15. However, the flange 422 received in the groove 306 prevents each mandrel sleeve 305 from similarly moving to the right and the shaft 278 progressively enters the sleeve 305 causing the disengagement of the detent 313 and the circumferential groove 288 whereupon each article A is released (FIG. 16) and is transferred to an associated rod 411 of the take-away conveyor 400. It should be noted that during the transfer of the articles A from the mandrels 270 the clamping means 290 are partially retracted into each sleeve 305 and the articles A fall from the exposed portion of the clamping means 290 under the weight thereof. Furthermore, as each groove 306 disengages with the flange 422 of the cam means 420 the biasing force of the associated spring 298 acting against the balls 295 through 297 force the return of the associated sleeve 305 to the position shown in FIG. 10 of the drawings. After the complete transfer of the articles the mandrels 270 are fully retracted by a cam track portion 448 which merges with the cam track portion 315, thereby repositioning the mandrels 270 to subsequently receive uncoated articles A from the transfer turret mechanism 157.

After the articles have been transferred to the take-away conveyor 400 the mandrels progressively enter a mandrel cleaning station 450 (FIGS. 1 and 4) which includes a reservoir 451 containing a cleaning solution (unnumbered). A partially submerged rotatable cleaning brush 452 is journalled in side walls (unnumbered) of the reservoir 451 and is rotated by a motor 453 driveably coupled to the brush 452 by a pulley 454, a pulley belt 455, another pulley 456, and a shaft 457 of the brush 452.

During the passage of the mandrels through the cleaning station 450 the mandrels 270 are rotated by a mechanism 460 (FIG. 4) which is identical to the mechanism 380, and a further description of the former is unnecessary for a complete understanding of this invention.

Vapors from the reservoir or housing 451 are withdrawn therefrom by a duct 461 (FIGS. 1 and 4) which is in fluid communication with the duct 395. The housing 451, the exhaust hood 390, the ducts associated therewith as well as the motor 395, are preferably supported by a common framework which can be moved to the left as viewed in FIG. 4 of the drawings to expose the front end of the apparatus 25 for inspection and/or repair. The common framework may, for example, include rollers (not shown) supported on rails which are in parallel relationship to each other and to the axis of rotation of the turret mechanism 230 to permit the accurate movement of the framework toward and away from the main conveyor 205.

As the mandrels pass beyond the brush 452 a nozzle 465 coupled to a conventional source of air directs the air against the mandrels to dry the same incident to the transfer of articles from the mechanism 40 in the manner heretofore described.

It was heretofore noted that the jam detecting means 87 (FIG. 6) associated with the mechanism 38 and the detecting means 185 associated with the mechanism 40 are connected to the main drive circuit (not shown) to deenergize the motor M and stop all driven components of the apparatus 25. Such complete stoppage would prevent those of the articles A upon the take-away conveyor mechanism 400 from being immediately delivered to the drying oven 410, and the still wet coating on the exteriors thereof could become marred by personnel working to restore the operation of the apparatus 25 or simply by contaminants in the air. Therefore, in accordance with this invention either or both of the detecting means may be coupled to the clutch de-activating mechanism 128 (by suitable circuitry) (not shown) to energize the mechanism 128 causing the uncoupling of the clutch plates 126, 130 thereby stopping all components of the apparatus except the take-away conveyor mechanism 400. The clutch disengaging means 128 includes a pair of upwardly inclined brackets 470–471, secured to opposite sides of the housing of the gear mechanism 123. A shaft 472 is positioned beneath the shaft 125 (FIG. 2) and is journalled for pivoting movement in the brackets 470, 471. An end portion (unnumbered) of the shaft 472 projects beyond the bracket 471 and fixedly secured thereto is a downwardly directed arm 473. The arm 473 is articulately connected to a piston rod 474 of a cylinder 475 into which air from a suitable source (not shown) is introduced and withdrawn by a solenoid operated valve (not shown), such as the valve 370 and the solenoid 371 of the control mechanism 360 (FIG. 1). The solenoid is a portion of an auxiliary circuit (not shown) which also includes the switch contacts of the switches 110, 195 (FIG. 8). Two upwardly directed arms 476, 477 are fixed to the shaft 472 and include detents (unnumbered) or pins which ride in an annular or circumferential groove 478 of a collar 480 fixed to the shaft 125. During the normal operation of the apparatus 25 the clutch plates 126, 130 are engaged (FIG. 2) and the piston rod 474 is retracted in the cylinder 475. Upon the detection of jammed articles of either or both of the switches 110, 195 the solenoid associated with the clutch disengaging mechanism 128 is energized to admit air into the cylinder 475 causing the outward projection of the piston rod 474. This movement of the piston rod 474 pivots the arm 473 in a clockwise direction (FIG. 3) and the rotation of the shaft 472 in this same direction causes clockwise rotation of the arms or brackets 477, 476. The detents carried by the arms 477, 476 act against the wall of the groove urging the collar 480 and the clutch plate 126 fixed thereto to the right as viewed in FIG. 2 to effect disengagement between the shafts 125 and 131. The shaft 124, however, continues rotating and the articles carried by the conveyor 400 are transferred to the oven 410. After articles A have been transferred to the oven 410 the main motor M is de-energized, the solenoid associated with the cylinder 475 is de-energized to restore the coupling of the clutch plates 126, 130 and the apparatus 25 is in condition for subsequent operation upon the removal of jammed articles.

Reference is now made to FIGS. 17 through 20 of the drawings which illustrate the apparatus 25 after the mandrels 270 have been removed and other mandrels 500 have been secured to the reduced end portions 264 of each of the mandrel-carrying members 262, and the mechanism 380 has been replaced by a mechanism 485. Except for the construction of the mandrels 500 and the mechanism 485, the apparatus 25 is otherwise identical to that heretofore described thus far.

Figure 17:
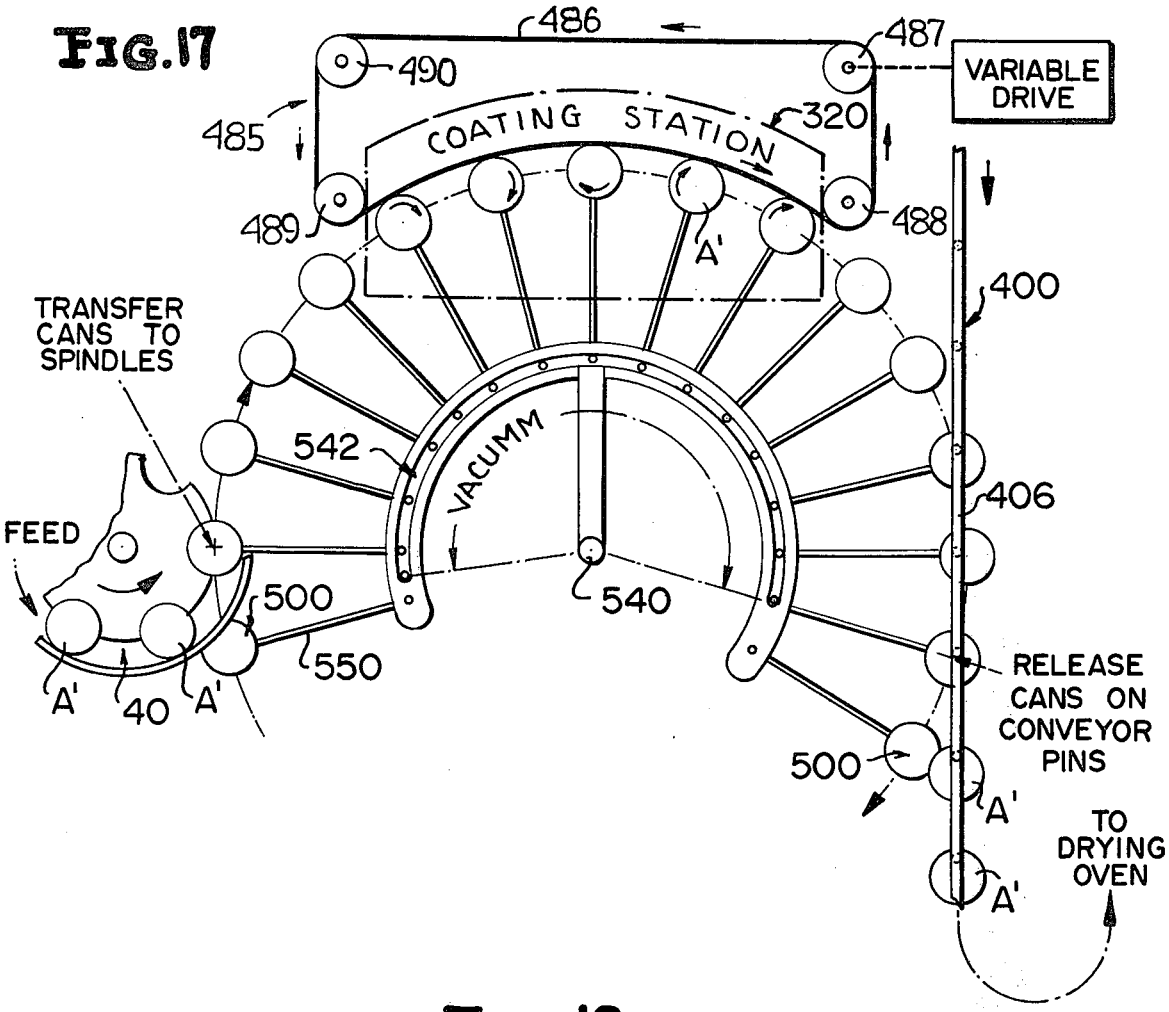
FIG. 17 is a highly schematic front elevational view of a modification of the apparatus of FIG. 1, and illustrates a source of vacuum in fluid communication with a plurality of mandrels having a vacuum-type article-clamping means.
Figure 19:
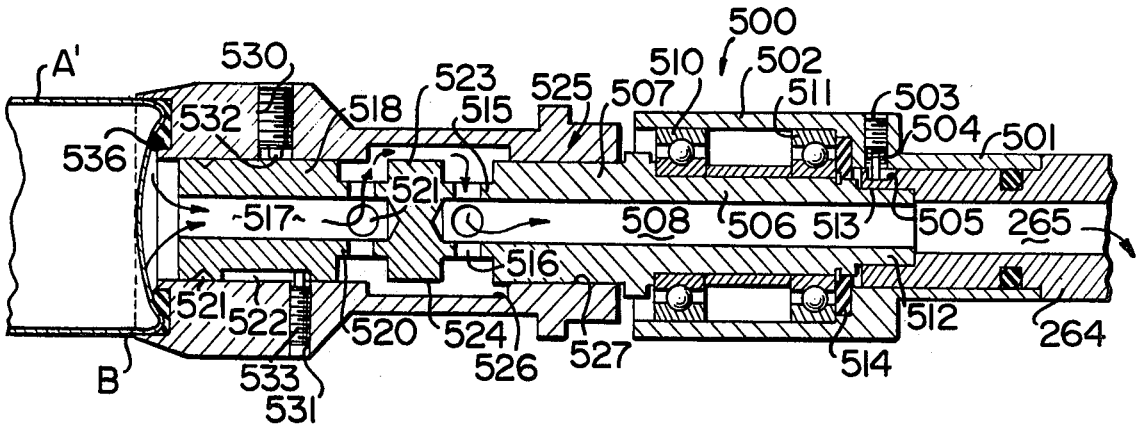
FIG. 19 is an enlarged sectional view taken generally along line 19—19 of FIG. 18, and illustrates the relative position of components of one of the mandrels when a vacuum is being drawn therethrough.

The mechanism 485 includes a pulley belt 486 entrained about pulleys 487-490 for movement in the direction of the unnumbered headed arrows in FIG. 17. The pulley 487 is connected by conventional means (unnumbered) to a variable drive source, such as an electric motor. The articles A′ passing through the coating station 320 are thereby rotated in a clockwise direction by the portion of the pulley belt between the pulleys 488, 489. Each article is preferably rotated 360° during its movement past each spray nozzle whereby a complete layer of coating material is applied to each article by each spray nozzle, as opposed to the partial coating of the articles in the manner heretofore described relative to FIG. 13 of the drawings. By varying the speed of the pulley belt 486 it is possible, of course, to apply a partial layer of coating material or a plurality of layers to each article by each spray nozzle.

Each of the mandrels 500 includes a sleeve 501 surrounding the reduced end portion 264 with the O-ring seal 272 positioned in the groove of the reduced end portion 264. Each sleeve 501 includes a cylindrical portion 502 having an internally threaded radial aperture 503 into which is threaded a set screw 504. The set screw 504 is received in a notch 505 of the reduced end portion 264 to removably secure the cylindrical portion 502 thereto. An end portion 506 of a shaft 507 having an axial bore 508 is received in the cylindrical portion 502 and is mounted for rotation therein by anti-friction bearing assemblies 510, 511. The bearing assemblies 510, 511 are retained in the cylindrical portion 502 in the manner heretofore described relative to the bearing assemblies 280, 281 of the article supporting mandrel 270, and a further description thereof is deemed unnecessary for a complete understanding of the mandrel 500. A reduced end portion 512 of the shaft 506 is received in a counterbore 513 of the reduced end portion 264, and a seal 514 prevents leakage betweeen the counterbore 513 and the end portion 512.

The axial bore 508 of the shaft 507 terminates adjacent a reduced annular wall portion 515 provided with a plurality of radial ports 516. Another axial bore 517 is formed in a forward end portion 518 of the shaft 507 and similarly terminates adjacent a reduced annular wall portion 520 provided with radial ports or passages 521. An annular radially outwardly opening groove 521 and an axially extending notch or slot 522 are also formed in the portion 518 of the shaft 507. An enlarged annular portion 523 is disposed includes an annular valve seat or face 524.

Figure 20:
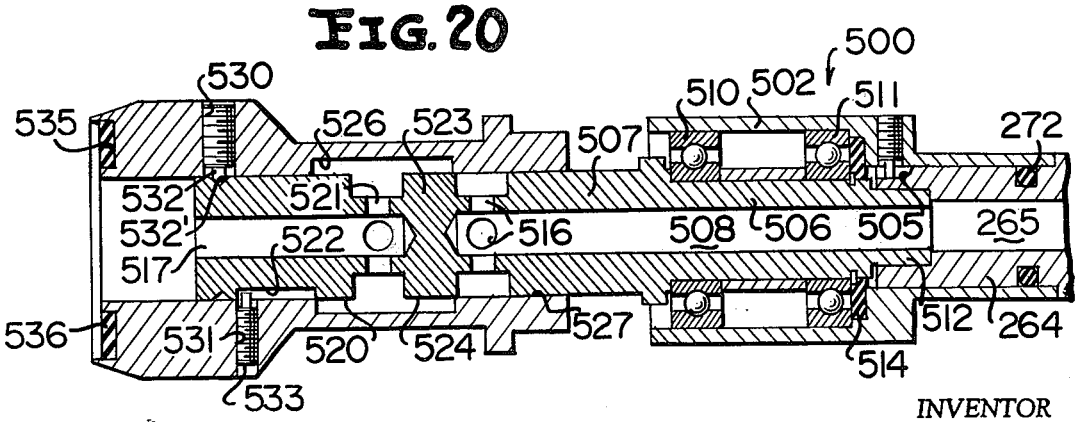
FIG. 20 is an axial sectional view of the mandrel of FIG. 19, and illustrates the relative position of the components in the inoperative position thereof.

A sleeve 525 surrounds the shaft 507 and includes an annular recess 526 and an annular valve seat 527 which cooperates with the valve seat 524 of the annular member or valve 523 in the A′position of the mandrel 500 (FIG. 20). The sleeve 525 is also provided with threaded radial bores 530, 531 in which are threadably received a respective inwardly spring-biased detent member 532 and A′set screw 533 positioned as shown in FIG. 20 of the drawings when the valve 523 is closed.

An axial end face (unnumbered) of the sleeve 525 is provided with an annular groove 535 in which is seated an annular gasket 536. A closed bottom end portion B (FIG. 19) of an article A', such as a one-piece metallic can body, is adapted to seat against the gasket 536 and be maintained in its seated position by atmosphere acting against the exterior of the article A' when a vacuum is drawn along a flow path diagramatically illustrated by the unnumbered headed arrows in FIG. 19 of the drawings.

Figure 18:
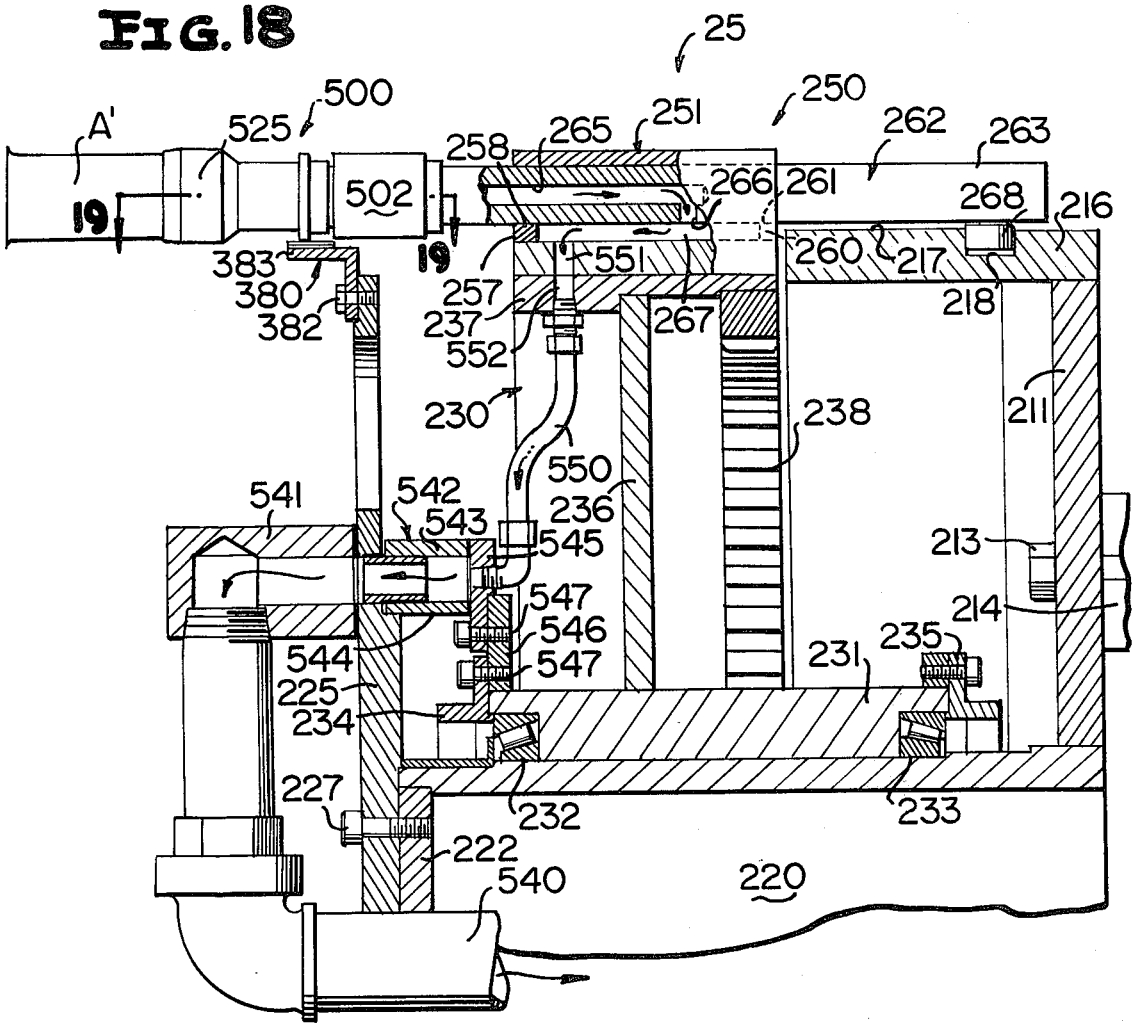
FIG. 18 is an enlarged fragmentary sectional view of a portion of the main conveyor taken generally along line 4—4 of FIG. 2, and illustrates the vacuum article-clamping mandrels reciprocally carried by the main conveyor, and means placing the mandrels in fluid communication with a vacuum source.

Reference is now made to FIGS. 17 and 18 of the drawings which illustrate a main header or conduit 540 which is connected to a conventional vacuum source (not shown) such as an exhaust pump. The header 540 is secured to the front plate 225 of the apparatus 25 by a coupling 541 and suitable seals (not shown). An arcuately-shaped vacuum manifold 542 is secured to the rear face (unnumbered) of the plate 225, and is defined by a pair of fixed arcuate plates 543, 544 and a movable annular plate 545 connected to the hub 231 of the turret mechanism by an annular plate 546 and a plurality of bolts 547. Conventional sealing means (now shown) are positioned between the plates 543, 544 and the plate 545 to prevent air leakage therebetween during the rotation of the plate 545. Conventional coupling elements (unnumbered) and a flexible conduit 550 connect the manifold 542 with each chamber 267 through ports 551, 552, in each of the respective plates 252 and 237.

As each mandrel 500 approaches the article transfer mechanism 40 its associated conduit 550 is placed into fluid communication with the manifold 543 and the source of vacuum (not shown) is placed in fluid communication with the radial ports 516 over a path defined by the ports 516, the bore 508, the bore 265, the radial port 266 (FIG. 18), the chamber 267, the ports 551, 552 and the conduit 550 the manifold 542, the coupling 541 and the main header 540. At this time, the cam follower 268 associated with the mandrel carrying member 262 is in cam track portion 315 of the cam track 218, as is readily visualized from the lowermost mandrel position shown in FIG. 9 of the drawings. In this position the valve 523 engages the valve seat 527 and a vacuum is not drawn through the axial bore 517, the radial ports 521 and the recess 526. However, as the turret mechanism continues to rotate the cam follower 268 travels along the portion 316 of the cam track 218 and is urged against the bottom B of an article A′ which is prevented from moving axially because of the back-up plate 200, whereupon the sleeve 525 is slid from the position illustrated in FIG. 20 to the position illustrated in FIG. 19 opening the valve and permitting the vacuum to act upon the article A′ upon an associated mandrel until the transfer thereof to the take-away conveyor 400. The transfer is effected in much the same manner as that heretofore described relative to FIG. 15 whereby the flange 422 of the cam mechanism 420 engages the radially outwardly directed flange (unnumbered) of the sleeve 525 and holds the same in position as the mandrel-carrying member 262 associated therewith is moved to the right, as viewed in FIG. 15, by the portion 447 of the cam track 218. Rotation of the sleeve 525 is also effected at the coating station and the mandrel cleaning station by the radial flange heretofore noted and associated with each of the mandrels 500. Thus, the apparatus 25 is readily converted to carry either open-ended or closed ended articles by merely attaching either of the mandrels 270, 500 to the mandrel-carrying members 262 and without materially changing any other components as, for example, the particular configuration of the cam track 218.

While preferred forms and arrangement of parts have been shown in illustrating the invention, it is to be clearly understood that various changes in details and arrangement of parts may be made without departing from the spirit and scope of the invention as defined in the appended claimed subject matter.

It is claimed:

1. Apparatus for spray-coating container bodies comprising means for conveying a plurality of container bodies along a predetermined path, a plurality of spray nozzles disposed adjacent a portion of the path for directing coating material against the container bodies, means for rotating the container bodies during the travel thereof along said path portion, a source of coating material, means placing said spray nozzles in fluid communication with said source of coating material, and means for sequentially actuating said spray nozzles to direct coating material from a first spray nozzle against a first circumferential portion of a container body and the entire axial length thereof but not completely about the entire circumference thereof, and to thereafter direct coating material from a second spray nozzle against a portion of said first circumferential portion and a second circumferential portion of said container body and the entire axial length thereof thereby circumferentially overlapping the coating material in the absence of a complete overlapping of the entire circumference of the container body.

2. The spray-coating apparatus as defined in claim 1 including a plurality of mandrels for supporting the container bodies during the movement thereof along said predetermined path, means for clamping each container body upon an associated mandrel, and means for reciprocating said mandrels in a direction generally normal to said predetermined path of container body travel during the application to and the removal of container bodies from said mandrels.

3. The apparatus as defined in claim 2 including a housing internally telescopically receiving each mandrel, said mandrels each having opposite opposed ends one of which carries said clamping means and another of which in part defines said reciprocating means, means carried by each of said one mandrel ends for unclamping said clamping means, and said unclamping means is mounted in external telescopic and reciprocal relationship to each of said one mandrel end.

4. The apparatus as defined in claim 2 including a housing internally telescopically receiving each mandrel, said mandrels each having opposite opposed ends one of which carries said clamping means and another of which in part defines said reciprocating means, means carried by each of said one mandrel ends for unclamping said clamping means, said unclamping means is mounted in external telescopic and reciprocal relationship to said one mandrel end, and means for reciprocating said unclamping means relative to said mandrel one end.

5. The apparatus as defined in claim 2 including a housing internally telescopically receiving each mandrel, said mandrels each having opposite opposed ends one of which carries said clamping means and another of which in part defines said reciprocating means, means carried by each of said one mandrel ends for unclamping said clamping means, said unclamping means is mounted in external telescopic and reciprocal relationship to said one mandrel end, means for reciprocating said unclamping means relative to said mandrel one end, and said last-mentioned reciprocating means is defined by cam and cam follower means of which one is carried by said unclamping means.

6. The apparatus as defined in claim 2 including a housing internally telescopically receiving each mandrel, said mandrels each having opposite opposed ends one of which carries said clamping means and another of which in part defines said reciprocating means, means carried by each of said one mandrel ends for unclamping said clamping means, said unclamping means is mounted in external telescopic and reciprocal relationship to said one mandrel end, means for reciprocating said unclamping means relative to said mandrel one end, said first and last mentioned reciprocating means are each defined by cam and cam follower means of which one is carried by each of said mandrels and said unclamping means.

7. The spray-coating apparatus as defined in claim 1 including a plurality of mandrels for supporting the container bodies during the movement thereof along said predetermined path, means for clamping each container body upon an associated mandrel, said clamping means including means for entering the interiors of the container bodies through openings therein, expansible means for interiorly gripping the container bodies, and means for collapsing the expansible means to facilitate the removal of the entering means from the container bodies at the termination of the coating thereof.

8. The spray-coating apparatus as defined in claim 7 wherein said entering means in a rod-like member, ball means carried by said rod-like member, means for normally biasing said ball means radially outwardly, said ball and biasing means defining said expansible means, said collapsing means being a sleeve in external telescopic relationship to said rod-like member, and means for reciprocating said sleeve in generally overlying relationship to said ball means to urge the same radially inwardly against the biasing means to effect the release of the container bodies from the mandrels.

9. The spray coating apparatus as defined in claim 8 wherein said last-mentioned reciprocating means includes cam follower means carried by said sleeve adapted for engagement with a contoured cam during movement of the mandrels along said predetermined path.

10. The spray-coating apparatus as defined in claim 7 wherein said collapsing means are each carried in external telescopic and reciprocal relationship to each mandrel.

11. The spray-coating apparatus as defined in claim 7 wherein said collapsing means are each carried in external telescopic and reciprocal relationship to each mandrel, and each collapsing means includes a cam follower adapted for engagement with a contoured cam during movement thereof along said predetermined path.

12. The spray-coating apparatus as defined in claim 1 including a plurality of mandrels for supporting the container bodies during the movement thereof along said predetermined path, means for clamping each container body upon an associated mandrel, said clamping means including support heads, a vacuum source, and means for placing said supporting heads in fluid communication with said vacuum source whereby atmospheric pressure maintains each container body in clamping engagement with its associated supporting head.

13. The spray-coating apparatus as defined in claim 1 including a plurality of mandrels for supporting the container bodies during the movement thereof along said predetermined path, each mandrel including a pair of relatively shiftable portions, said shiftable portions defining passage means through each of said mandrels, a vacuum source in fluid communication with said passage means, a valve within each mandrel, and means for selectively shifting said shiftable portions to selectively open and close said passage means by said valve whereby container bodies are respectively clamped upon and released from the mandrels.

14. The spray-coating apparatus as defined in claim 1 wherein said spray nozzles are disposed in spaced relationship along said path portion, and said spray nozzles are angularly inclined toward and in opposed relationship to the direction of travel of the container bodies along the predetermined path.

15. The apparatus as defined in claim 14 wherein said first spray nozzle is upstream of said second spray nozzle along said path portion.

16. The spray-coating apparatus as defined in claim 1 including an exhaust hood positioned at said path portion, and means for exhausting air and excess coating material from the interior of the exhaust hood.

17. The spray-coating apparatus as defined in claim 16 including a plurality of mandrels for supporting the container bodies during the movement thereof along said predetermined path, the predetermined path defined by said conveying means being disposed in a vertical plane, and means at a bottommost portion of the path for removing coating material from the mandrels.

18. The spray-coating apparatus as defined in claim 1 including a plurality of mandrels for supporting the container bodies during the movement thereof along said predetermined path, the predetermined path defined by said conveying means being disposed in a vertical plane, and means at a bottommost portion of the path for removing coating material from the mandrels.

19. The spray-coating apparatus as defined in claim 1 including a plurality of mandrels for supporting the container bodies during the movement thereof along said predetermined path, the predetermined path defined by said conveying means being disposed in a vertical plane, means at a bottommost portion of the path for removing coating material from the mandrels, said removing means including means for supplying coating removing material, and means for transferring the coating removing material from the supplying means to the mandrels.

20. The spray-coating apparatus as defined in claim 19 including an exhaust hood positioned at said path portion and at said removing means, and means for exhausting air from the interior of said exhaust hoods.

21. The apparatus as defined in claim 1 wherein said first spray nozzle is upstream of said second spray nozzle along said path portion.

* * * * *